US010361510B2

(12) United States Patent
Tanaka et al.

(10) Patent No.: US 10,361,510 B2
(45) Date of Patent: Jul. 23, 2019

(54) CONNECTOR, CONNECTOR SET, AND MANUFACTURING METHOD FOR CONNECTOR

(71) Applicant: Murata Manufacturing Co., Ltd., Kyoto-fu (JP)

(72) Inventors: Aoi Tanaka, Nagaokakyo (JP); Chikara Uratani, Nagaokakyo (JP); Minoru Ikeda, Nagaokakyo (JP); Shingo Nakamura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/212,482

(22) Filed: Dec. 6, 2018

(65) Prior Publication Data

US 2019/0115692 A1 Apr. 18, 2019

Related U.S. Application Data

(63) Continuation of application No. PCT/JP2017/017938, filed on May 11, 2017.

(30) Foreign Application Priority Data

Jun. 10, 2016 (JP) ..... 2016-115903

(51) Int. Cl.
*H01R 24/50* (2011.01)
*H01R 13/627* (2006.01)
(Continued)

(52) U.S. Cl.
CPC ..... *H01R 13/6272* (2013.01); *H01R 9/0515* (2013.01); *H01R 12/707* (2013.01);
(Continued)

(58) Field of Classification Search
CPC ..... H01R 9/0515; H01R 24/50
See application file for complete search history.

(56) References Cited

U.S. PATENT DOCUMENTS 7,008,235 B2 * 3/2006 Watanabe ..... H01R 24/50 439/581
7,648,394 B2 * 1/2010 Yotsutani ..... H01R 12/718 439/581

(Continued)

FOREIGN PATENT DOCUMENTS

JP H05266951 A 10/1993
JP 2013191341 A 9/2013
WO 2013/046829 A1 4/2013

OTHER PUBLICATIONS

International Search Report issued in PCT/JP2017/017938; dated Aug. 8, 2017.

(Continued)

*Primary Examiner* — Tho D Ta
(74) *Attorney, Agent, or Firm* — Studebaker & Brackett PC

(57) ABSTRACT

A connector, a connector set, and a manufacturing method for a connector that suppresses intrusion or radiation of noise. A first connector includes a first ground conductor including a first outer conductor having a cylindrical shape and a virtual first center axis extending in a first direction, and a first contact section connected to the first outer conductor; a first center conductor in an area surrounded by the first outer conductor when viewed from the first direction; and a first lock member. When the first connector and a second connector are connected to each other, the first outer conductor is inserted in a second outer conductor, the first lock member pushes the second connector toward one side of the first direction, and the first contact section contact (Continued)

a second ground conductor to surround the periphery of the first outer conductor when viewed from the first direction.

20 Claims, 18 Drawing Sheets

(51) Int. Cl.

| | |
|---|---|
| ***H01R 12/78*** | (2011.01) |
| ***H01R 12/70*** | (2011.01) |
| ***H01R 43/24*** | (2006.01) |
| ***H01R 12/77*** | (2011.01) |
| ***H01R 43/20*** | (2006.01) |
| ***H01R 9/05*** | (2006.01) |

(52) U.S. Cl.
CPC ..... *H01R 12/774* (2013.01); *H01R 12/775* (2013.01); *H01R 12/78* (2013.01); *H01R 13/6273* (2013.01); *H01R 24/50* (2013.01); *H01R 43/205* (2013.01); *H01R 43/24* (2013.01)

(56) References Cited

U.S. PATENT DOCUMENTS

| | | | | |
|---|---|---|---|---|
| 8,298,007 | B2 * | 10/2012 | Taguchi | H01R 13/6473 439/578 |
| 8,944,827 | B2 * | 2/2015 | Ohsaka | H01R 12/57 439/581 |
| 9,011,163 | B2 * | 4/2015 | Ohsaka | H01R 13/40 439/63 |
| 2011/0159708 | A1 | 6/2011 | Huang et al. | |

OTHER PUBLICATIONS

International Preliminary Report on Patentability and Written Opinion Issued in PCT/JP2017/017938; dated Dec. 11, 2018.

* cited by examiner

112:112a~112h
114:114a, 114b
115:115a, 115b
116:116a~116c
112c:122c, 124c
112d:122d, 124d
112e:126e, 128e, 130e
112f:122f, 124f
112g:122g, 124g
112h:126h, 128h, 130h

12 : 12a~12f
14 : 14a, 14b
15 : 15a, 15b
16 : 16a~16c
12c : 22c, 24c
12d : 22d, 24d

112 : 112a, 112b, 112i~112n
114 : 114a, 114b
115 : 115a, 115b
116 : 116a~116c

110b

112 : 112a~112d, 112o, 112p
114 : 114a, 114b
115 : 115a, 115b
116 : 116a~116c

110c

112:112a~112h
114:114a, 114b
116:116a~116c

CONNECTOR, CONNECTOR SET, AND MANUFACTURING METHOD FOR CONNECTOR

CROSS-REFERENCE TO RELATED APPLICATIONS

This application claims benefit of priority to International Patent Application No. PCT/JP2017/017938, filed May 11, 2017, and to Japanese Patent Application No. 2016-115903, filed Jun. 10, 2016, the entire contents of each are incorporated herein by reference.

BACKGROUND

Technical Field

The present disclosure relates to a connector, a connector set and a manufacturing method for the connector, and more particularly, to a connector, a connector set, and a manufacturing method for the connector including a center conductor and an outer conductor.

Background Art

As an disclosure relating to an existing connector, for example, a coaxial connector plug and a coaxial connector receptacle described in International Publication No. 2013/046829 are known. FIG. 17 is an external-appearance perspective view of a coaxial connector plug 500 described in International Publication No. 2013/046829. FIG. 18 is an external-appearance perspective view of a coaxial connector receptacle 600 described in International Publication No. 2013/046829.

The coaxial connector plug 500 includes an outer conductor 512 and a center conductor 514. When viewed from the upper side, the outer conductor 512 has a shape in which part of a circular ring is cut out (hereinafter, referred to as a "C shape"). The center conductor 514 is disposed at the center of the outer conductor 512 when viewed from the upper side.

The coaxial connector receptacle 600 includes an outer conductor 612 and a center conductor 614. When viewed from the upper side, the outer conductor 612 has an annular shape. The center conductor 614 is disposed at the center of the outer conductor 612 when viewed from the upper side.

The above-described coaxial connector plug 500 is connected to the coaxial connector receptacle 600 from the upper side, in a state in which the upper and lower sides in FIG. 17 are reversed. At this time, the outer conductor 612 is inserted in the outer conductor 512. The outer conductor 512 is formed in a C shape. Therefore, when the outer conductor 612 is inserted, the outer conductor 512 is elastically deformed so that its cutout is slightly widened. Thus, the inner circumference surface of the outer conductor 512 comes into contact with the outer circumference surface of the outer conductor 612, so that the outer conductor 512 holds the outer conductor 612.

SUMMARY

The inventors of the present disclosure have found that, in the coaxial connector plug 500 and the coaxial connector receptacle 600 described in International Publication No. 2013/046829, intrusion or radiation of noise is likely to occur. More specifically, due to the elastic deformation of the outer conductor 512, the inner circumference surface of the outer conductor 512 is in contact with the outer circumference surface of the outer conductor 612. However, it is hard for the inner circumference surface of the C-shaped outer conductor 512 to deform into a shape substantially matching the outer circumference surface of the annular-shaped outer conductor 612. Therefore, not the entire inner circumference surface of the outer conductor 512 is evenly in contact with the outer circumference surface of the outer conductor 612, but part of the inner circumference surface of the outer conductor 512 is in contact with part of the outer circumference surface of the outer conductor 612. As a result, a tiny gap is formed between the inner circumference surface of the outer conductor 512 and the outer circumference surface of the outer conductor 612. Such a gap may have a risk of being an entering path for the noise that enters the center conductors 514 and 614 from the exterior of the coaxial connector plug 500 and the coaxial connector receptacle 600, or a radiation path for the noise that is radiated from the center conductors 514 and 614 to the exterior of the coaxial connector plug 500 and the coaxial connector receptacle 600.

Accordingly, the present disclosure provides a connector, a connector set, and a manufacturing method for a connector that can suppress the intrusion or radiation of noise.

A first connector according to an embodiment of the present disclosure is a first connector to be connected, from one side of a first direction, to a second connector provided with a second ground conductor including a second outer conductor formed in a cylindrical shape and having a virtual second center axis extending in the first direction. The first connector includes a first ground conductor including a first outer conductor formed in a cylindrical shape and having a virtual first center axis extending in the first direction, and a first contact section connected to the first outer conductor; a first center conductor provided in an area surrounded by the first outer conductor when viewed from the first direction; a first insulator provided in the area surrounded by the first outer conductor when viewed from the first direction and configured to fix relative positions of the first center conductor and the first outer conductor; and a first lock member. In a case where the first connector and the second connector are connected to each other, the first outer conductor is inserted in the second outer conductor or the second outer conductor is inserted in the first outer conductor. In the case where the first connector and the second conductor are connected to each other, the first lock member pushes the second connector toward the one side of the first direction, and the first contact section makes contact with the second ground conductor in such a manner as to surround a periphery of the first outer conductor when viewed from the first direction.

A connector set according to an embodiment of the present disclosure is a connector set including a first connector and a second connector, wherein the first connector and the second connector are connected to each other in such a manner that the first connector is positioned on one side of a first direction relative to the second connector. In the connector set, the first connector includes a first ground conductor including a first outer conductor formed in a cylindrical shape and having a virtual first center axis extending in the first direction, and a first contact section connected to the first outer conductor; a first center conductor provided in an area surrounded by the first outer conductor when viewed from the first direction; a first insulator provided in the area surrounded by the first outer conductor when viewed from the first direction and configured to fix relative positions of the first center conductor and the first outer conductor; and a first lock member. Meanwhile, the second connector includes a second ground conductor including a second outer conductor formed in a cylindrical shape and having a virtual second center axis extending in the first direction, and a second contact section connected to the second outer conductor; a second center conductor provided in an area surrounded by the second outer conductor when viewed from the first direction; a second insulator provided in the area surrounded by the second outer conductor when viewed from the first direction and configured to fix relative positions of the second center conductor and the second outer conductor; and a second lock member. Further, the first outer conductor is inserted in the second outer conductor or the second outer conductor is inserted in the first outer conductor; and the first center conductor and the second center conductor are connected to each other. In a case where the first connector and the second conductor are connected to each other, the first lock member pushes the second lock member toward the one side of the first direction. In the case where the first connector and the second connector are connected to each other, the first contact section and the second contact section make contact with each other in such a manner as to surround a periphery of the first outer conductor and the second outer conductor when viewed from the first direction.

A manufacturing method for a first connector according to an embodiment of the present disclosure includes integrating the first ground conductor and the first center conductor by insert molding using the first insulator made of a resin material.

A manufacturing method for a first connector according to an embodiment of the present disclosure includes insert molding of any one of the first ground conductor and the first center conductor using the first insulator made of a resin material, and press fitting of the other one of the first ground conductor and the first center conductor into the first insulator.

According to the present disclosure, the intrusion or radiation of noise can be suppressed.

DETAILED DESCRIPTION

Hereinafter, a male connector, a female connector, and a connector set according to an embodiment will be described.

(Configuration of Male Connector)

Figure 1:
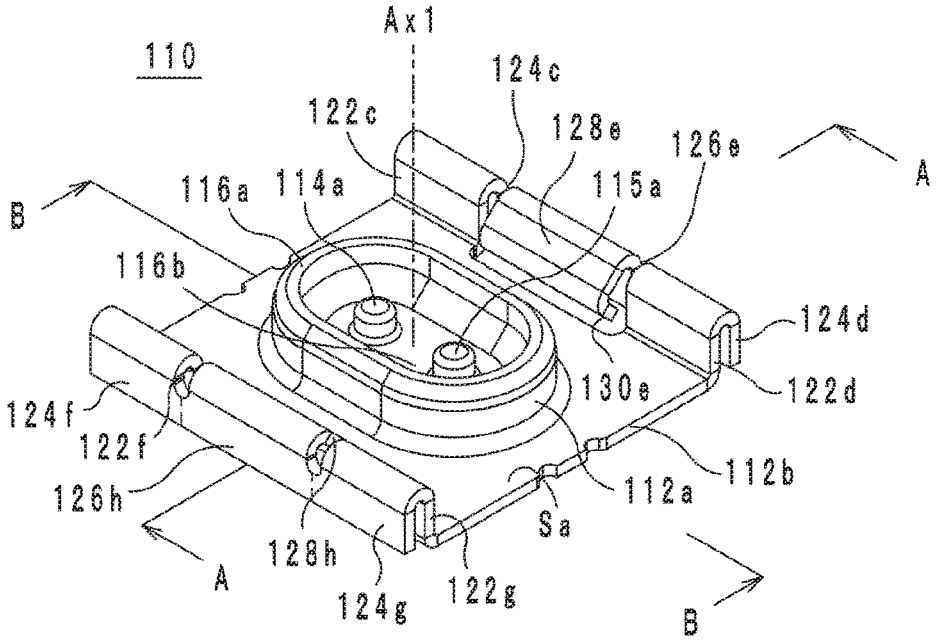
FIG. 1 is an external-appearance perspective view of a male connector when viewed from the upper side.
Figure 1:
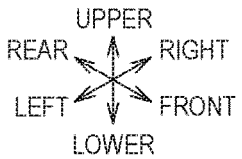
Figure 2:
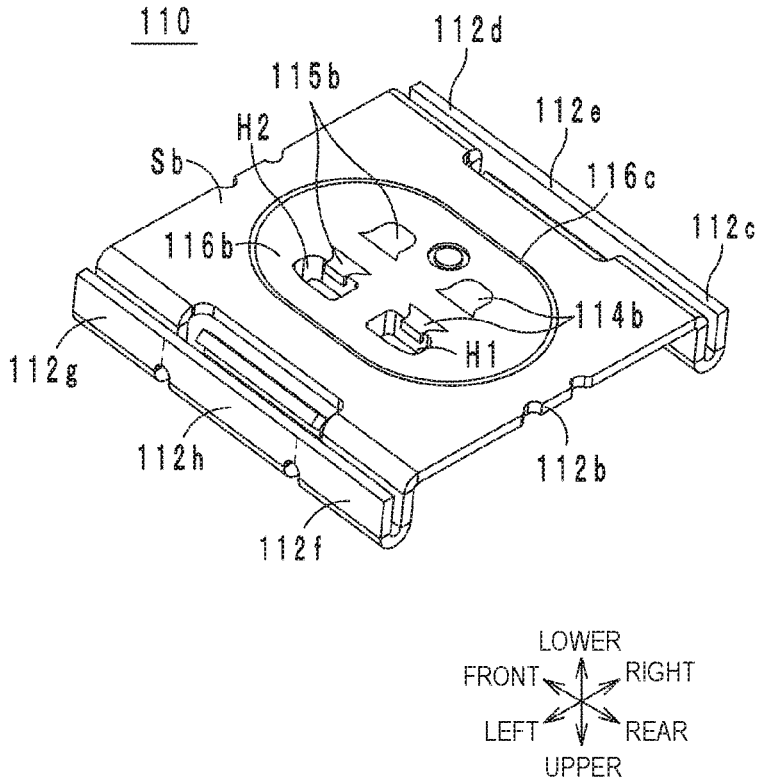
FIG. 2 is an external-appearance perspective view of the male connector when viewed from the lower side.
Figure 3:
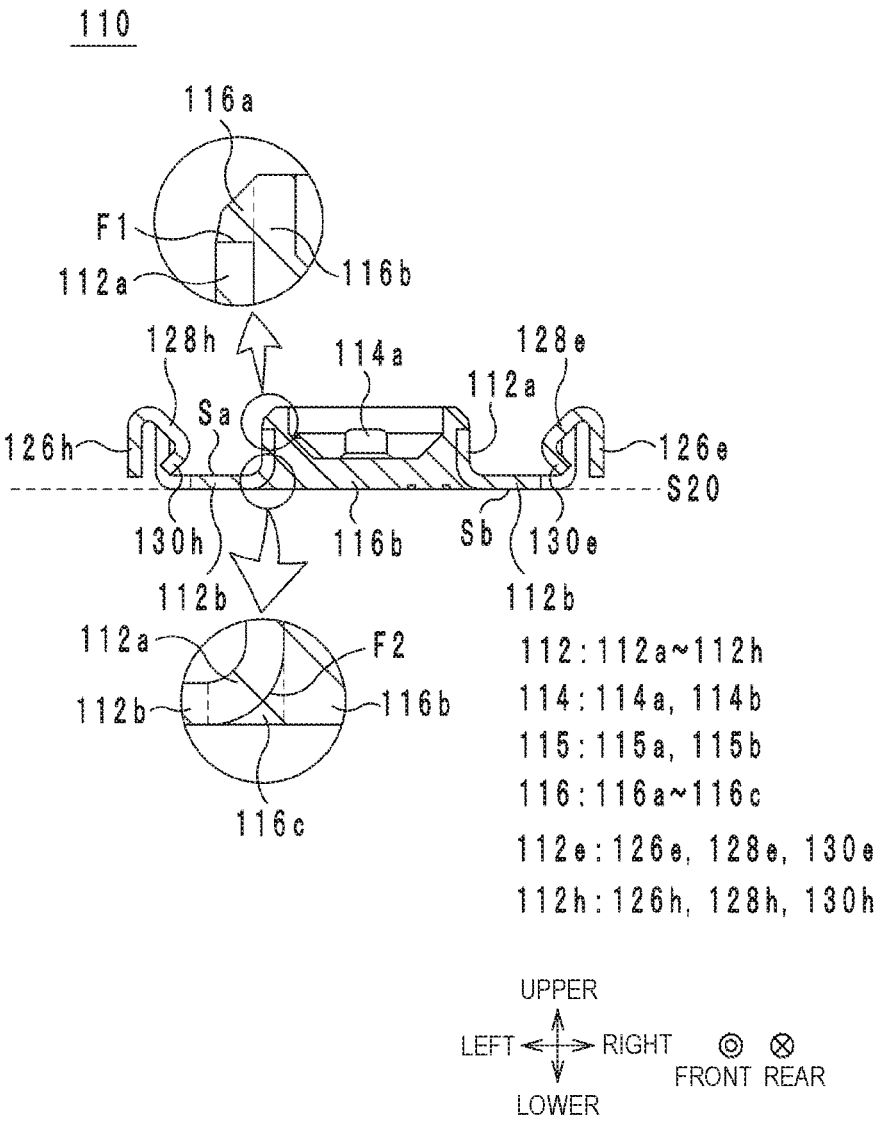
FIG. 3 is a cross-sectional structural view of the male connector taken along an A-A line in FIG. 1.
Figure 4:
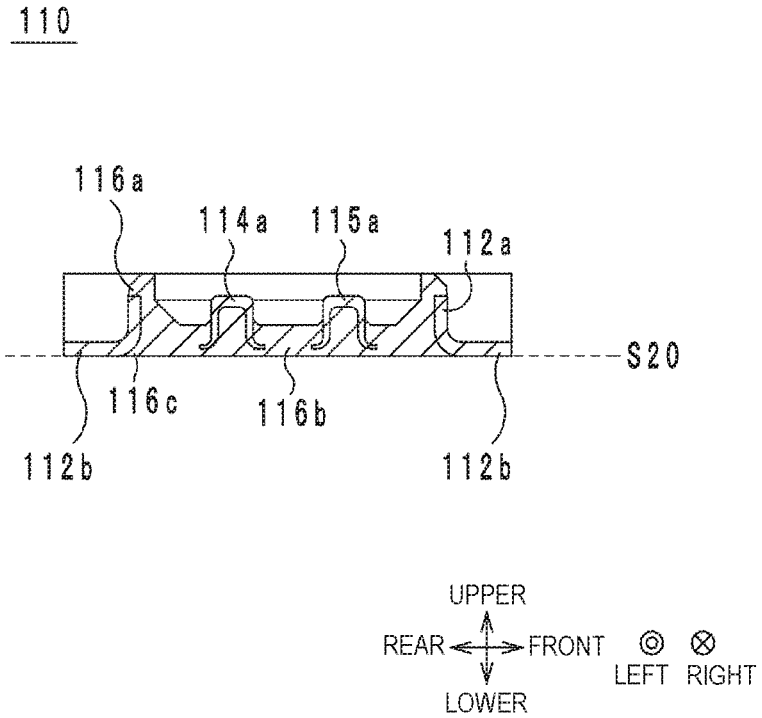
FIG. 4 is a cross-sectional structural view of the male connector taken along a B-B line in FIG. 1.

First, a male connector will be described with reference to the drawings. FIG. 1 is an external-appearance perspective view of the male connector 110 when viewed from the upper side. FIG. 2 is an external-appearance perspective view of the male connector 110 when viewed from the lower side. FIG. 3 is a cross-sectional structural view of the male connector 110 taken along an A-A line in FIG. 1. FIG. 4 is a cross-sectional structural view of the male connector 110 taken along a B-B line in FIG. 1.

Hereinafter, a normal direction of an upper surface Sa of a planar portion 112*b* of a ground conductor 112 is defined as an upper-lower direction. Further, when viewed from the upper side, a direction in which a center conductor 114 and a center conductor 115 are aligned is defined as a front-rear direction. Furthermore, a direction orthogonal to both the upper-lower direction and the front-rear direction is defined as a left-right direction. The upper-lower direction, the front-rear direction, and the left-right direction are orthogonal to each other. Note that, however, the upper-lower direction, the front-rear direction, and the left-right direction are directions defined for explanation, and may not match an upper-lower direction, a front-rear direction, and a left-right direction at a time when the male connector 110 is actually used.

The male connector 110 (an example of a first connector) is mounted on a circuit board such as a flexible printed circuit board, and includes the ground conductor 112, the center conductors 114 and 115, and an insulator 116, as illustrated in FIGS. 1 to 4.

The ground conductor 112 (an example of a first ground conductor) is manufactured by punching and bending a single metal plate (e.g., phosphor bronze) having conductive and elastic properties. Further, the ground conductor 112 is plated with Ni and Ag. As illustrated in FIGS. 1 to 4, the ground conductor 112 includes an outer conductor 112*a*, the planar portion 112*b*, support members 112*c*, 112*d*, 112*f* and 112*g*, and lock members 112*e* and 112*h* (an example of a first lock member).

The outer conductor 112*a* (an example of a first outer conductor) is formed in a cylindrical shape having a virtual center axis Ax1 (an example of a first center axis) extending in the upper-lower direction (an example of a first direction). When viewed from the upper side, the outer conductor 112*a* has an oval shape whose longitudinal direction extends in the front-rear direction. The outer conductor 112*a* has an oval cross-sectional shape at any position in the upper-lower direction. The above cross-sectional shape is a shape of a cross section orthogonal to the upper-lower direction. Thus, except for an upper-side opening and a lower-side opening, none of a cutout, a hole, and the like connecting the inside and the outside of the outer conductor 112*a* are provided in the outer conductor 112*a*. The center axis Ax1 is a line obtained by connecting the center of gravity of each of cross sections orthogonal to the upper-lower direction in the outer conductor 112*a*. However, since the center axis Ax1 is a virtual axis, it cannot be visually recognized.

The planar portion 112*b* is a plate-like member that is connected to a lower end of the outer conductor 112*a* (an example of an end portion on one side in the first direction) and has the upper surface Sa (an example of a main surface) and a lower surface Sb that are orthogonal to the upper-lower direction. The upper surface Sa and the lower surface Sb have a substantially rectangular shape. The long sides of the upper surface Sa and the lower surface Sb extend in the front-rear direction. The short sides of the upper surface Sa and the lower surface Sb extend in the left-right direction. When viewed from the upper side, the center of each of the upper surface Sa and the lower surface Sb (intersection of diagonal lines) matches the center axis Ax1 of the outer conductor 112*a*. The outer conductor 112*a* has a structure projecting toward the upper side from the planar portion 112*b*.

Here, a boundary between the outer conductor 112*a* and the planar portion 112*b* will be described with reference to an enlarged view in FIG. 3. The ground conductor 112 is manufactured by punching and bending a single metal plate. It is difficult to bend a metal plate at right angles in a bending process. Therefore, the vicinity of the lower end of the outer conductor 112*a* gradually curves to be separate from the center axis Ax1 toward the lower side. In the ground conductor 112, this curved portion is part of the outer conductor 112*a* and is not part of the planar portion 112*b*. In the ground conductor 112, the planar portion 112*b* is a portion which is not curved and is parallel to the front-rear direction and the left-right direction. Therefore, the height of the lower end of the outer conductor 112*a* in the upper-lower direction and the height of the lower surface Sb of the planar portion 112*b* in the upper-lower direction are equal to each other.

The support members 112*c* and 112*d* are connected to the planar portion 112*b* and aligned at a given interval in the front-rear direction (an example of a second direction). The support member 112*c* (an example of a first support member) is formed by bending a belt-like member extending from the vicinity of the rear end of the right long side of the planar portion 112*b* toward the right side. The support member 112*c* has a connection portion 122*c* and a leading end portion 124*c*. The connection portion 122*c* is bent at right angles with respect to the planar portion 112*b* so as to extend toward the upper side from the planar portion 112*b*. The leading end portion 124*c* is bent rightward from the upper end of the connection portion 122*c* so as to extend toward the lower side from the upper end of the connection portion 122*c*. Thus, the support member 112*c* has a U shape in which the upper and lower sides thereof are inverted when viewed from the front-rear direction. The support member 112*c* having the above structure can be elastically deformed so that an interval between the connection portion 122*c* and the leading end portion 124*c* is changed (particularly, widened).

The support member 112*d* (an example of a second support member) is formed by bending a belt-like member extending from the vicinity of the front end of the right long side of the planar portion 112*b* toward the right side. The support member 112*d* has a connection portion 122*d* and a leading end portion 124*d*. Since the structure of each of the connection portion 122*d* and the leading end portion 124*d* is the same as that of each of the connection portion 122*c* and the leading end portion 124*c*, description thereof will be omitted herein.

The lock member 112*e* is a leaf spring formed by bending part of the ground conductor 112, and is connected to the support members 112*c* and 112*d*. More specifically, the lock member 112*e* is located between the support member 112*c* and the support member 112*d* in the front-rear direction, and includes a connection portion 126*e*, an intermediate portion 128*e*, and a leading end portion 130*e*. The connection portion 126*e* has a belt-like shape extending in the front-rear direction. The rear end of the connection portion 126*e* is connected to the leading end portion 124*c* of the support member 112*c*. The front end of the connection portion 126*e* is connected to the leading end portion 124*d* of the support member 112*d*.

Further, the lock member 112*e* extends toward the upper side from the portion connected to the support members 112*c* and 112*d*, and bends leftward (that is, in a direction approaching the outer conductor 112*a*) so as to extend toward the lower side. In this embodiment, the intermediate portion 128*e* is connected to the upper end of the connection portion 126*e* and extends from the upper end of the connection portion 126*e* toward the lower left side. Further, the leading end portion 130*e* is connected to the lower end of the intermediate portion 128*e* and extends from the lower end of the intermediate portion 128*e* toward the lower right side. Further, the lower end of the leading end portion 130*e* is not connected to other configurations. The lock member 112*e* having the above structure can be elastically deformed so that a corner formed by the intermediate portion 128*e* and the leading end portion 130*e* moves in the left-right direction (particularly, to the right side).

The support members 112*f* and 112*g* are connected to the planar portion 112*b* and aligned at a given interval in the front-rear direction. Note that each of the structure of the support members 112*f* and 112*g* is plane-symmetric with the structure of each of the support members 112*c* and 112*d* with respect to a plane which passes through an intersection of diagonal lines of the upper surface Sa of the planar portion 112*b* and is perpendicular to the left-right direction. Therefore, detailed description of the support members 112*f* and 112*g* will be omitted.

The lock member 112*h* is a leaf spring formed by bending part of the ground conductor 112, and is connected to the support members 112*f* and 112*g*. Note that the structure of the lock member 112*h* is plane-symmetric with the structure of the lock member 112*e* with respect to a plane which passes through the intersection of the diagonal lines of the upper surface Sa of the planar portion 112*b* and is perpendicular to the left-right direction. Therefore, detailed description of the lock member 112*h* will be omitted.

The center conductors 114 and 115 (an example of a first center conductor) are manufactured by punching and bending a single metal plate (for example, phosphor bronze). Further, the center conductors 114 and 115 are plated with Ni and Ag. As illustrated in FIGS. 1 to 4, the center conductors 114 and 115 are so provided as to be aligned in that order from the rear side toward the front side in an area surrounded by the outer conductor 112*a* when viewed from the upper side.

The center conductor 114 includes a connection portion 114*a* and a mounting portion 114*b*. The connection portion 114*a* is formed in a cylindrical shape having a center axis extending in the upper-lower direction. Note that the upper end of the connection portion 114*a* is not opened. The mounting portion 114*b* is connected to the lower end of the connection portion 114*a*, and extends toward the lower side from the lower end of the connection portion 114*a*. As illustrated in FIG. 2, the lower end of the mounting portion 114*b* is positioned at the same height as the lower surface Sb in the upper-lower direction.

The center conductor 115 includes a connection portion 115*a* and a mounting portion 115*b*. However, since the structure of the center conductor 115 is the same as that of the center conductor 114, description thereof will be omitted.

The insulator 116 (an example of a first insulator) is provided in the area surrounded by the outer conductor 112*a* when viewed from the upper side, and fixes the relative positions of the center conductors 114, 115 and the outer conductor 112*a*. However, the insulator 116 may also be present outside the area surrounded by the outer conductor 112*a*. The insulator 116 includes retaining portions 116*a* and 116*c*, and a main body portion 116*b*. The main body portion 116*b* covers the entire inner circumference surface of the outer conductor 112*a*, and covers substantially the entire lower-side opening of the outer conductor 112*a*. However, as illustrated in FIG. 2, through-holes H1 and H2 passing through the main body portion 116*b* in the upper-lower direction are provided on the left side of each of the center conductors 114 and 115. When viewed from the upper side, the through-holes H1 and H2 are located in the area surrounded by the outer conductor 112*a*.

Further, the lower half of each of the connection portions 114*a* and 115*a*, and the mounting portions 114*b* and 115*b* are buried in the main body portion 116*b*. With this, the center conductors 114 and 115 are fixed to the insulator 116. Further, as illustrated in FIG. 2, the lower end of each of the mounting portions 114*b* and 115*b* (an example of one side of the first direction) is exposed from the main body portion 116*b*.

As illustrated in an enlarged view in FIG. 3, the retaining portion 116*a* is a portion of the insulator 116 located directly above the upper end of the outer conductor 112*a*. With this, the retaining portion 116*a* is in contact with a surface F1 facing the upper side in the outer conductor 112*a*.

As illustrated in the enlarged view in FIG. 3, the retaining portion 116*c* is a portion of the insulator 116 located directly under a portion that is gradually curved in the vicinity of the lower end of the outer conductor 112*a*. With this, the retaining portion 116*c* is in contact with a surface F2 facing the lower side in the outer conductor 112*a*. As illustrated in FIG. 2, the retaining portion 116*c* forms an oval ring when viewed from the lower side, and surrounds a periphery of the main body portion 116*b*. Then, the main body portion 116*b* and the retaining portion 116*c* form a single plane (lower surface of the insulator 116). Further, the lower surface of the insulator 116 and the lower surface Sb form a single plane.

Here, a positional relationship between the ground conductor 112 and the lower ends of the center conductors 114, 115 (lower ends of the mounting portions 114*b* and 115*b*) will be described. The height of the lower surface of the insulator 116 in the upper-lower direction and the height of the lower surface Sb in the upper-lower direction are equal to each other. Therefore, the lower surface of the insulator 116 and the lower surface Sb form a single plane. Further, as illustrated in FIG. 2, the lower ends of the center conductors 114 and 115 (i.e., the lower ends of the mounting portions 114*b* and 115*b*) are exposed from the lower surface of the insulator 116. Therefore, a plane S20 passing through the lower ends of the center conductors 114, 115 and being orthogonal to the upper-lower direction matches the plane formed by the lower surface of the insulator 116 and the lower surface Sb. Thus, the ground conductor 112 (the planar portion 112*b*) surrounds the periphery of the lower ends of the center conductors 114 and 115 on the plane S20. In other words, the lower end of each of the center conductors 114 and 115 does not protrude to the lower side from the ground conductor 112.

(Configuration of Female Connector)

Figure 5:
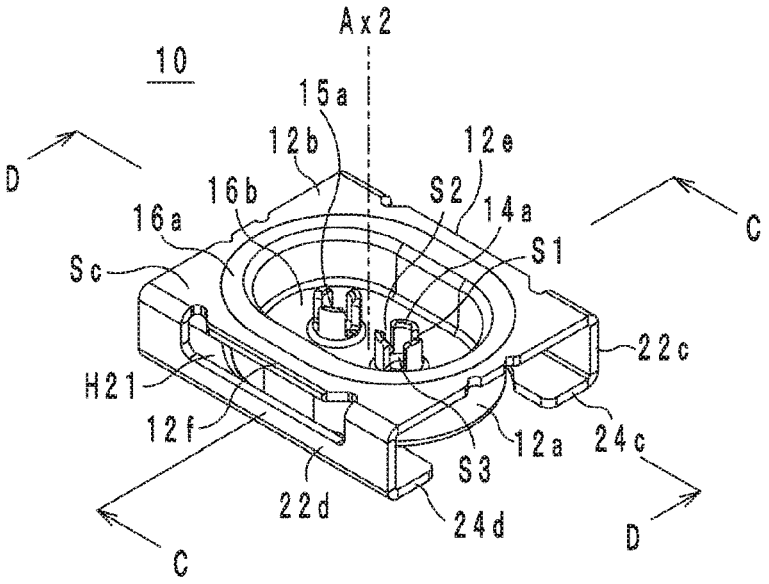
FIG. 5 is an external-appearance perspective view of a female connector when viewed from the lower side.
Figure 5:
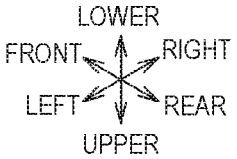
Figure 6:
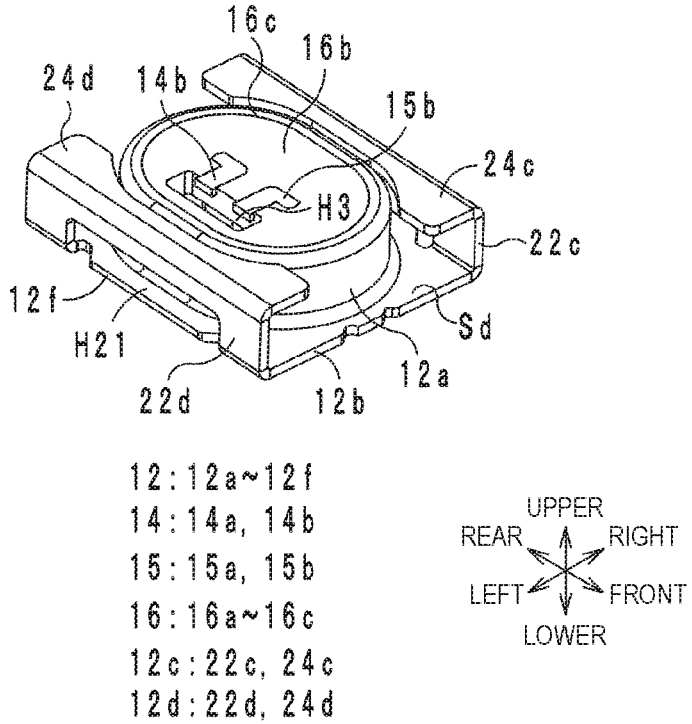
FIG. 6 is an external-appearance perspective view of the female connector when viewed from the upper side.
Figure 7:
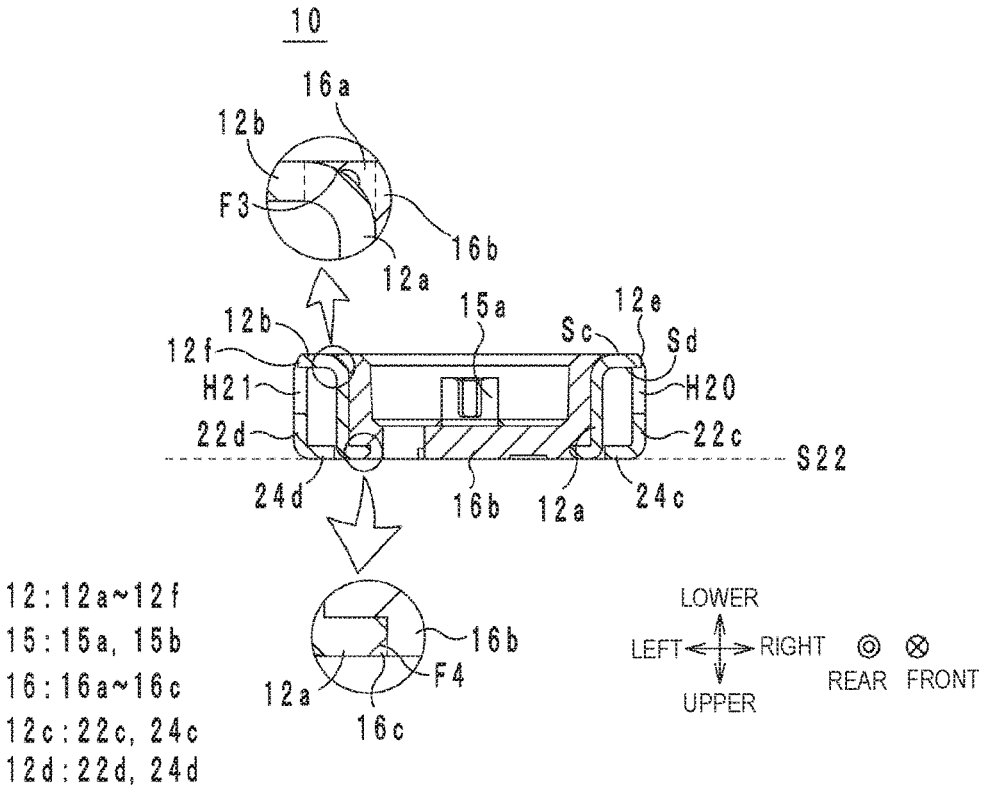
FIG. 7 is a cross-sectional structural view of the female connector taken along a C-C line in FIG. 5.
Figure 8:
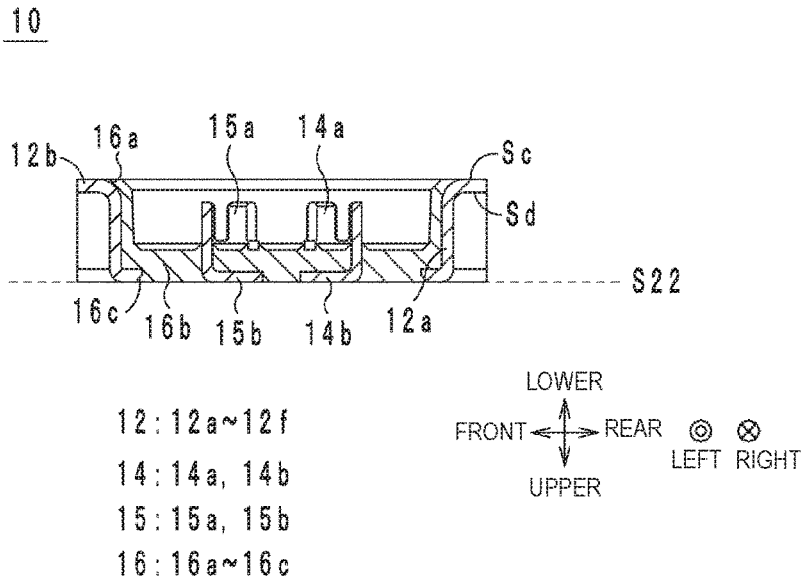
FIG. 8 is a cross-sectional structural view of the female connector taken along a D-D line in FIG. 5.

Next, a female connector will be described with reference to the accompanying drawings. FIG. 5 is an external-appearance perspective view of a female connector 10 when viewed from the lower side. FIG. 6 is an external-appearance perspective view of the female connector 10 when viewed from the upper side. FIG. 7 is a cross-sectional structural view of the female connector 10 taken along a C-C line in FIG. 5. FIG. 8 is a cross-sectional structural view of the female connector 10 taken along a D-D line in FIG. 5.

Hereinafter, a normal direction of a planar portion 12*b* of a ground conductor 12 is defined as an upper-lower direction. Further, when viewed from the lower side, a direction in which a center conductor 14 and a center conductor 15 are aligned is defined as a front-rear direction. Furthermore, a direction orthogonal to both the upper-lower direction and the front-rear direction is defined as a left-right direction. The upper-lower direction, the front-rear direction, and the left-right direction are orthogonal to each other. Note that, however, the upper-lower direction, the front-rear direction, and the left-right direction are directions defined for explanation, and may not match an upper-lower direction, a front-rear direction, and a left-right direction at a time when the female connector 10 is actually used.

The female connector 10 (an example of a second connector) is mounted on a circuit board such as a flexible printed circuit board, and includes the ground conductor 12, the center conductors 14 and 15, and an insulator 16 as illustrated in FIGS. 5 to 8.

The ground conductor 12 (an example of a second ground conductor) is manufactured by punching and bending a single metal plate (e.g., phosphor bronze) having conductive and elastic properties. Further, the ground conductor 12 is plated with Ni and Ag. As illustrated in FIGS. 5 to 8, the ground conductor 12 includes an outer conductor 12*a*, the planar portion 12*b*, support members 12*c* and 12*d*, and lock members 12*e* and 12*f* (an example of a second lock member).

The outer conductor 12*a* (an example of a second outer conductor) is formed in a cylindrical shape having a virtual center axis Ax2 (an example of a second center axis) extending in the upper-lower direction. When viewed from the lower side, the outer conductor 12*a* has an oval shape whose longitudinal direction extends in the front-rear direction. The outer conductor 12*a* has an oval cross-sectional shape at any position in the upper-lower direction. Thus, except for an upper-side opening and a lower-side opening, none of a cutout, a hole, and the like connecting the inside and the outside of the outer conductor 12*a* are provided in the outer conductor 12*a*. Further, as illustrated in FIG. 7, the upper end of the outer conductor 12*a* is bent in a direction approaching the center axis Ax2.

The planar portion 12*b* is a plate-like member that is connected to the lower end of the outer conductor 12*a* and includes a lower surface Sc and an upper surface Sd orthogonal to the upper-lower direction. The lower surface Sc and the upper surface Sd have a substantially rectangular shape.

The long sides of the lower surface Sc and the upper surface Sd extend in the front-rear direction. The short sides of the lower surface Sc and the upper surface Sd extend in the left-right direction. When viewed from the lower side, the center of the lower surface Sc and the upper surface Sd (intersection of diagonal lines) matches the center axis Ax2 of the outer conductor 12*a*. The outer conductor 12*a* has a structure projecting toward the upper side from the planar portion 12*b*.

Here, a boundary between the outer conductor 12*a* and the planar portion 12*b* will be described with reference to an enlarged view in FIG. 7. The ground conductor 12 is manufactured by punching and bending a single metal plate. It is difficult to bend a metal plate at right angles in a bending process. Therefore, the vicinity of the lower end of the outer conductor 12*a* gradually curves to be separate from the center axis Ax2 toward the lower side. In the ground conductor 12, this curved portion is part of the outer conductor 12*a* and is not part of the planar portion 12*b*. The planar portion 12*b* is a portion which is not curved in the ground conductor 12 and is parallel to the front-rear direction and the left-right direction. Therefore, the height of the lower end of the outer conductor 12*a* in the upper-lower direction and the height of the lower surface Sc of the planar portion 12*b* in the upper-lower direction are equal to each other.

The support members 12*c* and 12*d* are connected to the planar portion 12*b*. The support member 12*c* is formed by bending a substantially rectangular member extending from a right long side of the planar portion 12*b* toward the right side. The support member 12*c* includes a side surface portion 22*c* and a mounting portion 24*c*. The side surface portion 22C is bent at right angles with respect to the planar portion 12*b* so as to extend toward the upper side from the planar portion 12*b*. The mounting portion 24*c* is bent at right angles with respect to the side surface portion 22*c* so as to extend from the upper end of the side surface portion 22*c* toward the left side. As a result, the support member 12*c* has an L shape when viewed from the front side.

Note that an opening H20 (see FIG. 7) is provided in the side surface portion 22*c*. When viewed from the right side, the opening H20 has a substantially rectangular shape having a long side extending in the front-rear direction. The opening H20 is provided in a region of the lower half of the side surface portion 22*c*. With this, the side surface portion 22*c* is connected to the planar portion 12*b* only near the front and rear ends of the right long side of the planar portion 12*b*.

The support member 12*d* is formed by bending a substantially rectangular member extending from a left long side of the planar portion 12*b* toward the left side. The support member 12*d* includes a side surface portion 22*d* and a mounting portion 24*d*. Note that the structure of each of the side surface portion 22*d* and the mounting portion 24*d* is plane-symmetric with the structure of each of the side surface portion 22*c* and the mounting portion 24*c* with respect to a plane which passes through an intersection of diagonal lines of the lower surface Sc of the planar portion 12*b* and is perpendicular to the left-right direction. Therefore, detailed description of the side surface portion 22*d* and the mounting portion 24*d* will be omitted herein.

The lock member 12*e* is connected to the planar portion 12*b*. More specifically, the lock member 12*e* is a projection slightly projecting from the right long side of the planar portion 12*b* to the right side. When viewed from the upper side, the lock member 12*e* has an isosceles trapezoidal shape. The lower bottom of the lock member 12*e* matches the right long side of the planar portion 12*b*. Further, the lock member 12*e* is provided at a position overlapping with the opening H20 in the front-rear direction.

The lock member 12*f* is connected to the planar portion 12*b*. Note that the structure of the lock member 12*f* is plane-symmetric with the structure of the lock member 12*e* with respect to a plane which passes through the intersection of the diagonal lines of the lower surface Sc of the planar portion 12*b* and is perpendicular to the left-right direction. Therefore, detailed description of the side surface portion 22*d* and the mounting portion 24*d* will be omitted herein.

The center conductors 14 and 15 (an example of a second center conductor) are manufactured by punching and bending a single metal plate (for example, phosphor bronze). Further, the center conductors 14 and 15 are plated with Ni and Ag. As illustrated in FIGS. 5 to 8, the center conductors 14 and 15 are so provided as to be aligned in that order from the rear side toward the front side within an area surrounded by the outer conductor 12*a* when viewed from the lower side.

The center conductor 14 includes a connection portion 14*a* and a mounting portion 14*b*. The connection portion 14*a* is formed in a cylindrical shape having a center axis extending in the upper-lower direction. Note that the lower end of the connection portion 14*a* is open. In addition, the connection portion 14*a* is provided with three slits Si to S3 extending in the upper-lower direction. With this, the connection portion 14*a* can be elastically deformed so that the diameter of the connection portion 14*a* is changed (particularly, widened) when viewed from the lower side.

The mounting portion 14*b* is connected to the upper end of the connection portion 14*a*, and extends toward the upper side from the upper end of the connection portion 14*a*. As illustrated in FIGS. 6 and 8, the upper end of the mounting portion 14*b* is positioned at the same height as the upper end of the outer conductor 12*a* in the upper-lower direction.

The center conductor 15 includes a connection portion 15*a* and a mounting portion 15*b*. However, since the structure of the center conductor 15 is the same as that of the center conductor 14, description thereof will be omitted.

The insulator 16 (an example of a second insulator) is provided inside the area surrounded by the outer conductor 12*a* when viewed from the lower side, and fixes relative positions of the center conductors 14, 15 and the outer conductor 12*a*. However, the insulator 16 may also be provided outside the area surrounded by the outer conductor 12*a*. The insulator 16 includes retaining portions 16*a* and 16*c*, and a main body portion 16*b*. The main body portion 16*b* covers the entire inner circumference surface of the outer conductor 12*a*, and covers substantially the entire upper-side opening of the outer conductor 12*a*. However, as illustrated in FIG. 6, a through-hole H3 passing through the main body portion 16*b* in the upper-lower direction is provided on the left side of the center conductors 14 and 15. When viewed from the lower side, the through-hole H3 is located in the area surrounded by the outer conductor 12*a*.

Further, the mounting portions 14*b* and 15*b* are buried in the main body portion 16*b*. With this, the center conductors 14 and 15 are fixed to the insulator 16. As illustrated in FIG. 8, the upper end of each of the mounting portions 14*b* and 15*b* (an example of the other side of the first direction) is exposed from the main body portion 16*b*.

As illustrated in the enlarged view in FIG. 7, the retaining portion 16*a* is a portion of the insulator 16 located directly under a portion that is gradually curved in the vicinity of the lower end of the outer conductor 12*a*. With this, the retaining portion 16*a* is in contact with a surface F3 facing the lower side in the outer conductor 12*a*.

As illustrated in the enlarged view in FIG. 7, the retaining portion 16*c* is a portion of the insulator 16 that makes contact, from the upper side, with a portion where the upper end of the outer conductor 12*a* is bent. More specifically, the upper end of the outer conductor 12*a* is bent so as to approach the center axis Ax2 of the outer conductor 12*a*. Then, chamfering is performed on a corner of the leading end of the portion where the outer conductor 12*a* is bent. With this, a surface F4 facing an oblique upper side is formed at the leading end of the portion where the outer conductor 12*a* is bent. The retaining portion 16*c* is a portion that makes contact with the surface F4 formed by the chamfering, and is located on the upper side relative to the surface F4 in the insulator 16.

As illustrated in FIG. 6, the retaining portion 16*c* forms an oval ring when viewed from the lower side, and surrounds a periphery of the main body portion 16*b*. Then, the main body portion 16*b* and the retaining portion 16*c* form a single plane (i.e., an upper surface of the insulator 16). Further, the upper surface of the insulator 16 and the upper end of the outer conductor 12*a* form a single plane.

Here, a positional relationship between the ground conductor 12 and the upper ends of the center conductors 14, 15 (the upper ends of the mounting portions 14*b*, 15*b*) will be described. The height of the upper surface of the insulator 16 in the upper-lower direction and the height of the upper end of the outer conductor 12*a* in the upper-lower direction are equal to each other. Therefore, the upper surface of the insulator 16 and the upper end of the outer conductor 12*a* form a single plane. Further, as illustrated in FIG. 6, the upper end of each of the center conductors 14 and 15 (i.e., the upper end of each of the mounting portions 14*b* and 15*b*) is exposed from the upper surface of the insulator 16. Due to this, a plane S22 passing through the upper ends of the center conductors 14, 15 and being orthogonal to the upper-lower direction matches the plane formed by the upper surface of the insulator 16 and the upper end of the outer conductor 12*a*. Accordingly, the ground conductor 12 (outer conductor 12*a*) surrounds the periphery of the upper ends of the center conductors 14 and 15 on this plane S22. In other words, the upper end of each of the center conductors 14 and 15 does not protrude to the upper side from the ground conductor 12.

(Connection of Male Connector and Female Connector)

Figure 9:
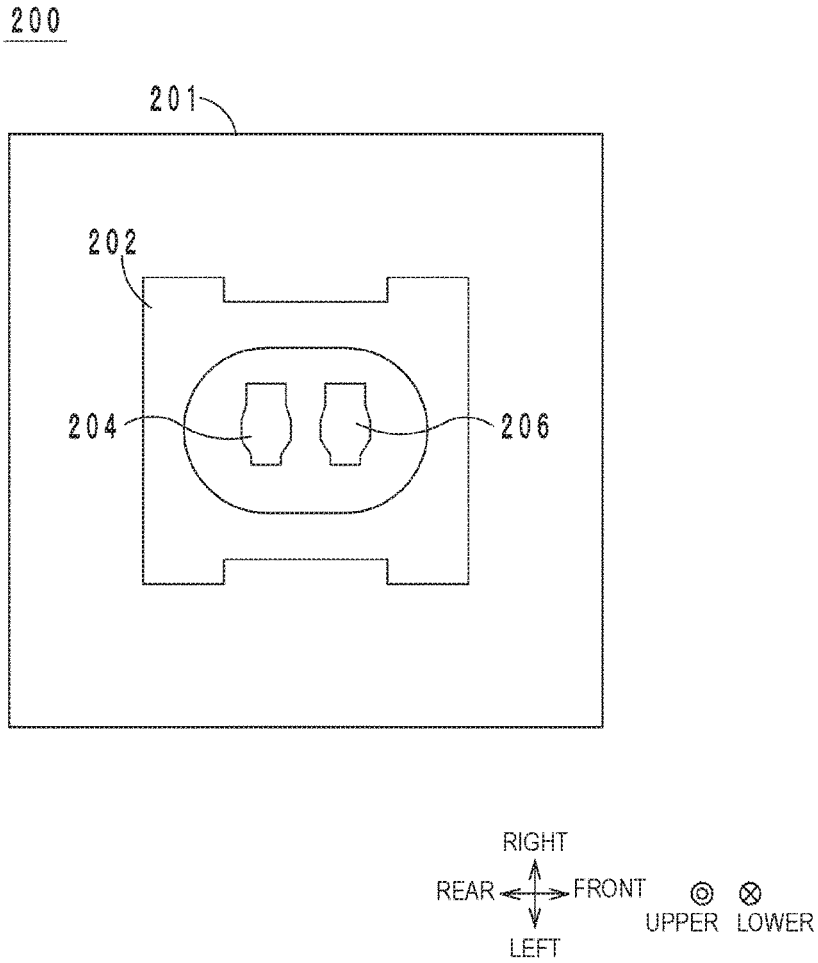
FIG. 9 is a diagram illustrating a circuit board on which the male connector is mounted.
Figure 10:
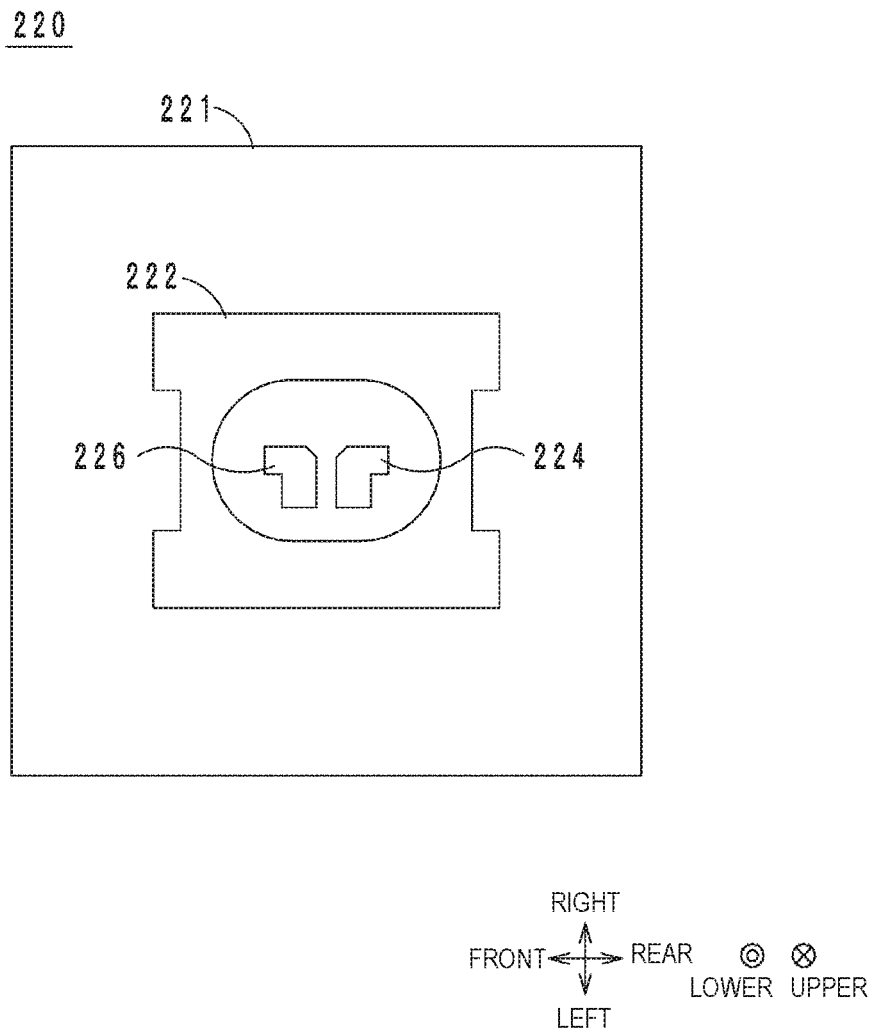
FIG. 10 is a diagram illustrating a circuit board on which the female connector is mounted.
Figure 11:
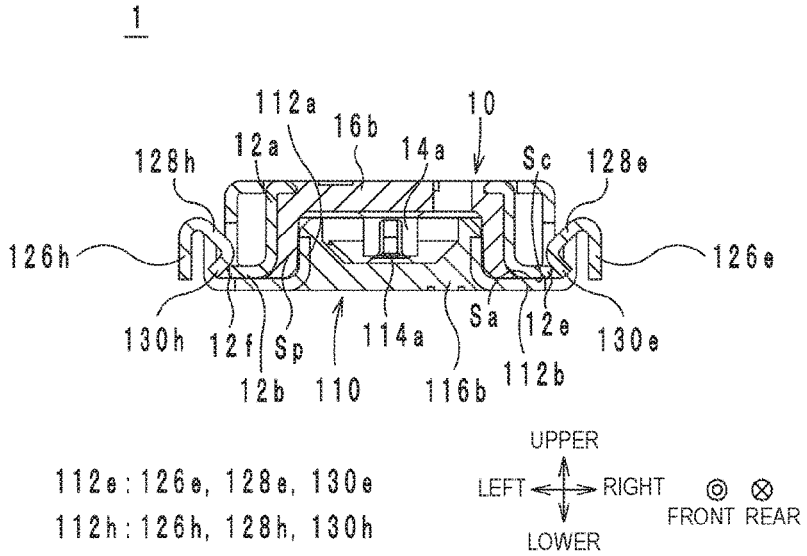
FIG. 11 is a cross-sectional structural view of a connector set in which the male connector and the female connector are connected to each other.

Hereinafter, the connection of the male connector 110 and the female connector 10 will be described with reference to the accompanying drawings. FIG. 9 is a diagram illustrating a circuit board 200 on which the male connector 110 is mounted. FIG. 10 is a diagram illustrating a circuit board 220 on which the female connector 10 is mounted. In FIGS. 9 and 10, an area in which the male connector 110 and the female connector 10 are mounted is enlarged and illustrated. FIG. 11 is a cross-sectional structural view of a connector set 1 in which the male connector 110 and the female connector 10 are connected to each other.

The circuit board 200 illustrated in FIG. 9 includes a board main body 201 and land electrodes 202, 204, and 206. The board main body 201 is a plate member formed in a plate shape, and has an upper surface and a lower surface. The land electrode 202 is provided on the upper surface of the board main body 201 and is formed in a shape matching the lower surface Sb of the planar portion 112*b* when viewed from the upper side. In other words, the land electrode 202 has a substantially rectangular outer edge. Note that an area in which no oval conductor is disposed is provided in the vicinity of the center of the land electrode 202. The land electrodes 204 and 206 are so disposed as to be aligned in that order from the rear side toward the front side within an area formed in an oval shape, respectively. In other words, the land electrodes 204 and 206 are disposed at the positions corresponding to the lower ends of the mounting portions 114*b* and 115*b*, respectively.

When the male connector 110 is mounted on the circuit board 200, solder cream is applied to the land electrodes 202, 204, and 206. Then, the male connector 110 is set on the upper surface of the circuit board 200 such that the lower surface Sb contacts the land electrode 202 and the lower ends of the mounting portions 114*b* and 115*b* contact the land electrodes 204 and 206. After that, the solder is melted in a heating process, and then the solder is solidified in a cooling process. As a result, the male connector 110 is mounted on the circuit board 200.

The circuit board 220 illustrated in FIG. 10 includes a board main body 221 and land electrodes 222, 224, and 226. The board main body 221 is a plate member formed in a plate shape, and has an upper surface and a lower surface. The land electrode 222 is provided on the lower surface of the board main body 221, and has a shape substantially matching the mounting portions 24*c* and 24*d* when viewed from the lower side. Note that the land electrode 222 is not isolated into two portions like the mounting portions 24*c* and 24*d*, and is formed in a substantially rectangular shape as one continuous shape. Note that in the vicinity of the center of the land electrode 222, an area in which no oval conductor is disposed is provided. The land electrodes 224 and 226 are disposed in that order from the rear side toward the front side in an oval area, respectively. In other words, the land electrodes 224 and 226 are disposed at the positions corresponding to the upper ends of the mounting portions 14*b* and 15*b*, respectively.

When the female connector 10 is mounted on the circuit board 220, solder is applied to the land electrodes 222, 224, and 226. Then, the female connector 10 is set on the lower surface of the circuit board 220 such that the mounting portions 24*c* and 24*d* contact the land electrode 222, and the upper ends of the mounting portions 14*b* and 15*b* contact the land electrodes 224 and 226. After that, the solder is melted in a heating process, and then the solder is solidified in a cooling process. As the result, the female connector 10 is mounted on the circuit board 220.

The male connector 110 and the female connector 10 mounted on the circuit boards 200 and 220, as described above, are connected to each other so that the male connector 110 is positioned on the lower side relative to the female connector 10 as illustrated in FIG. 11. In other words, the male connector 110 is connected to the female connector 10 from the lower side. To rephrase, the female connector 10 is so connected as to be positioned on the upper side relative to the male connector 110. That is, the female connector 10 is connected to the male connector 110 from the upper side. At this time, the outer conductor 112*a* is inserted in the outer conductor 12*a* from the lower side. However, the inner circumference surface of the outer conductor 12*a* is covered with the insulator 16. Therefore, the outer circumference surface of the outer conductor 112*a* comes into contact with the insulator 16 and does not make contact with the inner circumference surface of the outer conductor 12*a*. Thus, the male connector 110 and the female connector 10 are positioned in the front-rear direction and in the left-right direction.

When the male connector 110 is connected to the female connector 10, the connection portion 114*a* is inserted in the connection portion 14*a* from the lower side. Thus, the connection portion 14*a* and the connection portion 114*a* are electrically connected.

When the outer conductor 112*a* enters the outer conductor 12*a* from the lower side, the lock members 12*e* and 12*f* come into contact with the lock members 112*e* and 112*h* (more precisely, the intermediate portion 128*e* and an intermediate portion 128*h*), respectively, from the upper side. Further, when the outer conductor 112*a* goes up, the lock member 12*e* pushes the lock member 112*e* to the right direction side, and the lock member 12*f* pushes the lock member 112*h* to the left direction side. With this, in FIG. 11, the lock members 112*e* and 112*h* are elastically deformed, and the interval between the lock member 112*e* and the lock member 112*h* is widened. Further, when the outer conductor 112*a* goes up, the lock member 12*e* passes through the connection portion between the intermediate portion 128*e* and the leading end portion 130*e* (i.e., the corner of the lock member 112*e*) and enters into the lower side of the above connection portion, and the lock member 12*f* passes through the connection portion between the intermediate portion 128*h* and a leading end portion 130*h* (i.e., the corner of the lock member 112*h*) and enters into the lower side of the connection portion. Thus, the lock members 112*e* and 112*h* make contact with the lock members 12*e* and 12*f* at the leading end portions 130*e* and 130*h*, respectively, to return to the original state. The leading end portion 130*e* has a surface facing the lower left side, and the leading end portion 130*h* has a surface facing the lower right. With this, the leading end portions 130*e* and 130*h* push the lock members 12*e* and 12*f*, respectively, to the lower side. At this time, due to the reaction, the lock members 12*e* and 12*f* push the lock members 112*e* and 112*h*, respectively, to the upper side. As described above, the lock members 112*e* and 112*h* are elastic members that are elastically deformed to push the female connector 10 to the lower side. Then, the upper surface Sa (an example of a first plane) of the planar portion 112*b* (an example of a first contact section) and the lower surface Sc (an example of a second planar surface) of the planar portion 12*b* (an example of a second contact section) make surface contact with each other. When viewed from the upper side, the upper surface Sa surrounds the periphery of the outer conductor 112*a*. When viewed from the upper side, the lower surface Sc surrounds the periphery of the outer conductor 12*a*. Accordingly, the upper surface Sa (the planar portion 112*b*) and the lower surface Sc (the planar portion 12*b*) are in contact with each other in such a manner as to surround the periphery of the outer conductors 112*a* and 12*a* when viewed from the upper side. Thus, the ground conductor 12 and the ground conductor 112 are electrically connected to each other.

In the connector set 1 as described above, a high frequency signal is applied to the center conductors 14, 15, 114, and 115. The high frequency signal applied to the center conductors 14, 114 and the high frequency signal applied to the center conductors 15, 115 are a differential transmission signal, for example. The ground conductors 12 and 112 are maintained at a ground potential.

(Manufacturing Method for Male Connector and Female Connector)

Hereinafter, manufacturing methods for the male connector 110 and the female connector 10 will be described. Since the manufacturing method for the male connector 110 and the manufacturing method for the female connector 10 are substantially the same, the manufacturing method for the male connector 110 will be described, and description of the manufacturing method for the female connector 10 will be omitted herein.

First, a metal plate of phosphor bronze is punched and bent to produce the ground conductor 112 as illustrated in FIG. 1. Note that the metal plate only needs to have conductivity and elasticity, and a metal plate other than phosphor bronze may be used.

Next, a metal plate of phosphor bronze is punched and bent to produce the center conductors 114, 115 and the ground conductor 112 as illustrated in FIG. 1. Note that the metal plate only needs to have conductivity and elasticity, and a metal plate other than phosphor bronze may be used.

Next, the ground conductor 112, the center conductors 114 and 115, and the insulator 116 made of a resin material are integrated by insert molding. More specifically, the ground conductor 112 and the center conductors 114, 115 are set in a mold, and a molten resin (for example, a liquid crystal polymer) is injected into the mold. Thereafter, the resin is cooled and cured. Through the above processes, the male connector 110 is completed.

Note that, after the ground conductor 112 and the insulator 116 made of a resin material are integrated by insert molding, the center conductors 114 and 115 may be press-fitted into the insulator 116. Alternatively, after the center conductors 114, 115 and the insulator 116 made of a resin material are integrated by insert molding, the ground conductor 112 may be press-fitted into the insulator 116.

(Effect)

According to the male connector 110, the female connector 10, and the connector set 1 configured as described above, intrusion or radiation of noise can be suppressed. More specifically, the outer conductors 112*a* and 12*a* have a cylindrical shape, and the outer conductor 112*a* is inserted in the outer conductor 12*a*. In this case, a space Sp between the inner circumference surface of the outer conductor 12*a* and the outer circumference surface of the outer conductor 112*a* (see FIG. 11) and a space in which the center conductors 114, 115, 14, and 15 are disposed (inner space of the outer conductor 112*a*), are not isolated by any conductor but are connected to each other. Thus, in a case where a large number of noise paths connecting the space Sp and a space outside the outer conductor 12*a* are present, there is a risk that noise enters the center conductors 114, 115, 14, and 15 from the outside of the outer conductor 12*a* through the above-mentioned paths and the space Sp. Likewise, there is a risk that noise is radiated from the center conductors 114, 115, 14, and 15 to the outside of the outer conductor 12*a* through the space Sp and the above paths. To deal with the above issues, in the male connector 110, the female connector 10, and the connector set 1, when the male connector 110 and the female connector 10 are connected, the planar portion 112*b* and the planar portion 12*b* make contact with each other in such a manner as to surround the periphery of the outer conductors 112*a* and 12*a* when viewed from the upper side. With this, the number of noise paths connecting the space Sp and the space outside the outer conductor 12*a* is decreased. As a result, according to the male connector 110, the female connector 10, and the connector set 1, it is possible to suppress the intrusion or radiation of noise.

According to the male connector 110, the female connector 10, and the connector set 1, the male connector 110 and the female connector 10 are fixed to each other. More specifically, the outer conductor 512 described in International Publication No. 2013/046829 is elastically deformed to hold the outer conductor 612. On the other hand, since the outer conductor 12*a* is not elastically deformed, it does not hold the outer conductor 112*a*. The outer conductors 12*a* and 112*a* merely perform positioning of the male connector 110 and the female connector 10 in the front-rear direction and in the left-right direction by the outer conductor 112*a* being inserted in the outer conductor 12*a*. As such, the male connector 110 includes the lock members 112*e* and 112*h* configured to push the lock members 12*e* and 12*f* of the female connector 10 to the lower side when the male connector 110 and the female connector 10 are connected. With this, the female connector 10 is pressed against the male connector 110 so that the male connector 110 and the female connector 10 are positioned in the upper-lower direction, and the male connector 110 and the female connector 10 are fixed.

As described above, according to the male connector 110, the female connector 10, and the connector set 1, the outer conductors 12*a* and 112*a* are not elastically deformed in order to suppress the intrusion and radiation of noise. That is, each of the outer conductors 12*a* and 112*a* does not have a lock function. Instead, the male connector 110 includes the lock members 112*e* and 112*h* configured to push the lock members 12*e* and 12*f* of the female connector 10 to the lower side. In other words, the male connector 110 and the female connector 10 have a lock function at different portions other than the outer conductors 12*a* and 112*a*. Thus, according to the male connector 110, the female connector 10, and the connector set 1, it is possible to both suppress the intrusion or the radiation of noise and fix the male connector 110 and the female connector 10 at the same time, which has been difficult to realize by the known art.

Further, according to the male connector 110, the female connector 10, and the connector set 1, it is possible to more effectively suppress the intrusion and radiation of noise because of the following reasons. More specifically, the planar portion 112*b* includes the upper surface Sa. The planar portion 12*b* includes the lower surface Sc. Then, when the male connector 110 and the female connector 10 are connected to each other, the upper surface Sa and the lower surface Sc are brought into surface contact with each other. With this, it is more effectively suppressed that a noise path is formed between the upper surface Sa and the lower surface Sc so that it is possible to more effectively suppress the intrusion and radiation of noise.

Further, according to the male connector 110, the female connector 10, and the connector set 1, it is possible to easily connect the male connector 110 and the female connector 10 to each other. More specifically, the lock member 112*e* extends toward the upper side from the portion connected to the support members 112*c* and 112*d*, and bends toward a direction approaching the outer conductor 112*a* (left side) so as to extend toward the lower side. Further, the lock member 112*h* extends toward the upper side from the portion connected to the support members 112*f* and 112*g*, and bends toward a direction approaching the outer conductor 112*a* (right side) so as to extend toward the lower side. As a result, the leading ends of the lock members 112*e* and 112*h* face the lower side. Accordingly, when the male connector 110 is connected from the lower side of the female connector 10, it is possible to suppress a situation in which the leading ends of the lock members 112*e* and 112*h* are caught by the female connector 10. As a result, according to the male connector 110, the female connector 10, and the connector set 1, it is possible to easily connect the male connector 110 and the female connector 10 to each other. Further, by adjusting an angle formed by the connection portion 126*e* and the intermediate portion 128*e* and an angle formed by a connection portion 126*h* and the intermediate portion 128*h*, it is possible to adjust the strength of the fixing of the male connector 110 and the female connector 10.

Further, according to the male connector 110, the female connector 10, and the connector set 1, the male connector 110 and the female connector 10 are firmly fixed. More specifically, by the lock member 112*e* pushing the lock member 12*e* to the lower left side, the lock member 112*e* is pushed to the upper right side by the reaction. When the lock member 112*e* is displaced to the right side due to this reaction, the force of the lock member 112*e* pushing the lock member 12*e* becomes small. Therefore, the lock member 112*e* is positioned between the support member 112*c* and the support member 112*d*, and is connected to the support member 112*c* and the support member 112*d*. Thus, the lock member 112*e* is supported from both the front and rear sides. As a result, the displacement of the lock member 112*e* to the right side due to the reaction is suppressed. Accordingly, the lock member 112*e* pushes the lock member 12*e* with a sufficiently large force, so that the male connector 110 and the female connector 10 are firmly fixed. It can be said that the lock member 112*h* functions in a similar manner to that of the lock member 112*e*.

Further, according to the male connector 110, the female connector 10, and the connector set 1, it is possible to suppress a situation in which the insulator 116 is disengaged from the ground conductor 112 toward the upper side. More specifically, the insulator 116 is in contact with the surface F2 of the outer conductor 112*a* facing the lower side, as illustrated in the enlarged view in FIG. 3. Thus, even if the insulator 116 is subjected to an upward force, it will be caught by the surface F2. As a result, it is possible to suppress the situation in which the insulator 116 is disengaged from the ground conductor 112 toward the upper side.

Further, according to the male connector 110, the female connector 10, and the connector set 1, it is possible to suppress a situation in which the insulator 116 is disengaged from the ground conductor 112 toward the lower side. More specifically, the insulator 116 is in contact with the surface F1 of the outer conductor 112*a* facing the upper side, as illustrated in the enlarged view in FIG. 3. Thus, even if the insulator 116 is subjected to a downward force, it will be caught by the surface F1. As a result, it is possible to suppress the situation in which the insulator 116 is disengaged from the ground conductor 112 toward the lower side.

Further, according to the male connector 110, the female connector 10, and the connector set 1, it is possible to suppress a situation in which the insulator 16 is disengaged from the ground conductor 12 toward the upper side. More specifically, the insulator 16 is in contact with the surface F3 of the outer conductor 12*a* facing the lower side, as illustrated in the enlarged view in FIG. 7. Thus, even if the insulator 16 is subjected to an upward force, it will be caught by the surface F3. As a result, it is possible to suppress the situation in which the insulator 116 is disengaged from the ground conductor 112 toward the upper side.

Further, according to the male connector 110, the female connector 10, and the connector set 1, it is possible to suppress a situation in which the insulator 16 is disengaged from the ground conductor 12 toward the lower side. More specifically, the insulator 16 is in contact with the surface F4 of the outer conductor 12*a* facing the upper side, as illustrated in the enlarged view in FIG. 7. Thus, even if the insulator 16 is subjected to a downward force, it will be caught by the surface F4. As a result, it is possible to suppress the situation in which the insulator 16 is disengaged from the ground conductor 12 toward the lower side.

In addition, the through-holes H1 and H2 passing through the main body portion 116*b* in the upper-lower direction are provided on the left side of each of the center conductors 114 and 115. Therefore, it can be visually recognized that the center conductors 114 and 115 are soldered to the land electrodes 204 and 206 through the through-holes H1 and H2. Further, by providing the through-holes H1 and H2, flux rising is also suppressed.

Further, on the left side of each of the center conductors 14 and 15, the through-hole H3 passing through the main body portion 16*b* in the upper-lower direction is provided. Therefore, it can be visually recognized that the center conductors 14 and 15 are soldered to the land electrodes 224 and 226 through the through-hole H3. Further, by providing the through-hole H3, flux rising is also suppressed.

Further, according to the male connector 110, the female connector 10, and the connector set 1, the positioning of the male connector 110 and the female connector 10 in the front-rear direction and in the left-right direction can be accurately performed. Hereinafter, a connector set in which an outer circumference surface of an outer conductor 812 corresponding to the outer conductor 112*a* and an inner circumference surface of an outer conductor 712 corresponding to the outer conductor 12*a* are directly in contact with each other, will be described as a connector set according to a reference example. Note that the connector set according to the reference example is an example of the connector set according to the present disclosure.

The outer conductors 712 and 812 are manufactured by bending a metal plate, or the like. Since the machining accuracy of the stated conductors 712 and 812 is not relatively high, it is difficult to make the outer circumference surface of the outer conductor 812 and the inner circumference surface of the outer conductor 712 come into close contact with each other.

Meanwhile, in the female connector 10, the insulator 16 covers the inner circumference surface of the outer conductor 12*a*. The outer conductor 112*a* is inserted in the outer conductor 12*a*. This causes the insulator 16 to make contact with the outer circumference surface of the outer conductor 112*a*. The insulator 16 is manufactured by, for example, injection molding in which a resin is injected into a mold. The machining accuracy of the above insulator 16 is higher than that of the outer conductor 612 manufactured by bending a metal plate. Therefore, it is easy to make the insulator 16 be in close contact with the outer circumference surface of the outer conductor 12*a*. As a result, according to the male connector 110, the female connector 10, and the connector set 1, the positioning of the male connector 110 and the female connector 10 in the front-rear direction and in the left-right direction can be accurately performed. Note that, however, the outer circumference surface of the outer conductor 112*a* and the outer circumference surface of the outer conductor 12*a* may be directly in contact with each other.

Further, according to the male connector 110, the female connector 10, and the connector set 1, intrusion or radiation of noise can be suppressed. More specifically, in the male connector 110, the ground conductor 112 (the planar portion 112*b*) surrounds the periphery of the lower ends of the center conductors 114 and 115 on the plane S20. The plane S20 is a plane which passes through the lower ends of the center conductors 114 and 115, and is orthogonal to the upper-lower direction. As a result, the lower end of each of the center conductors 114 and 115 does not protrude to the lower side from the ground conductor 112. Accordingly, when the male connector 110 is mounted on the circuit board 200, the lower end of each of the center conductors 114 and 115 is covered with the outer conductor 112*a* when viewed from the front-rear direction and the left-right direction. As a result, it is possible to suppress a situation in which noise enters the vicinity of the lower ends of the center conductors 114 and 115, a situation in which noise is radiated from the vicinity of the lower ends of the center conductors 114 and 115, and the like. Further, in the female connector 10, the ground conductor 12 (the planar portion 12*b*) surrounds the periphery of the upper ends of the center conductors 14 and 15 on the plane S22. The plane S22 is a plane which passes through the upper ends of the center conductors 14 and 15, and is orthogonal to the upper-lower direction. Therefore, according to the female connector 10, it is possible to suppress the intrusion or radiation of noise due to the same reason as that in the male connector 110.

Further, according to the male connector 110, the female connector 10, and the connector set 1, it is possible to suppress the intrusion or radiation of noise due to the following reasons as well. More specifically, the lower end of each of the center conductors 114 and 115 is surrounded by the outer conductor 112*a* when viewed from the lower side, and does not exist outside the outer conductor 112*a*. With this, in the male connector 110, a situation in which noise enters the center conductors 114 and 115, and a situation in which noise is radiated from the center conductors 114 and 115 to the outside of the outer conductor 112*a* are suppressed. Also, due to the same reason described above, in the female connector 10, a situation in which noise enters the center conductors 14 and 15, and a situation in which noise is radiated from the center conductors 14 and 15 to the outside of the outer conductor 12*a* are suppressed.

(First Variation)

Figure 12:
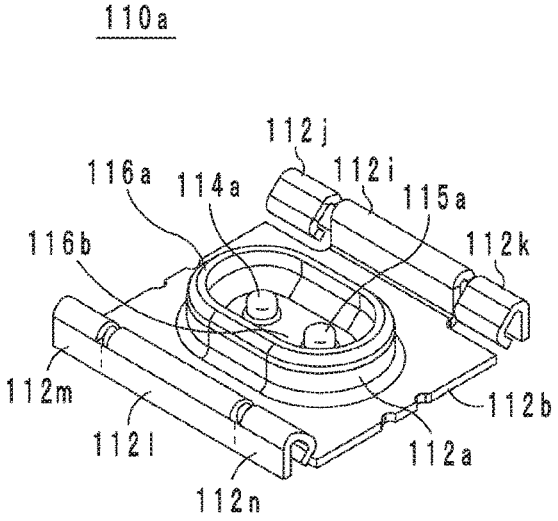
FIG. 12 is an external-appearance perspective view of a male connector when viewed from the upper side.
Figure 12:
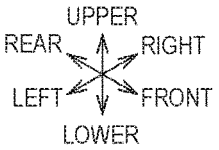
Figure 13:
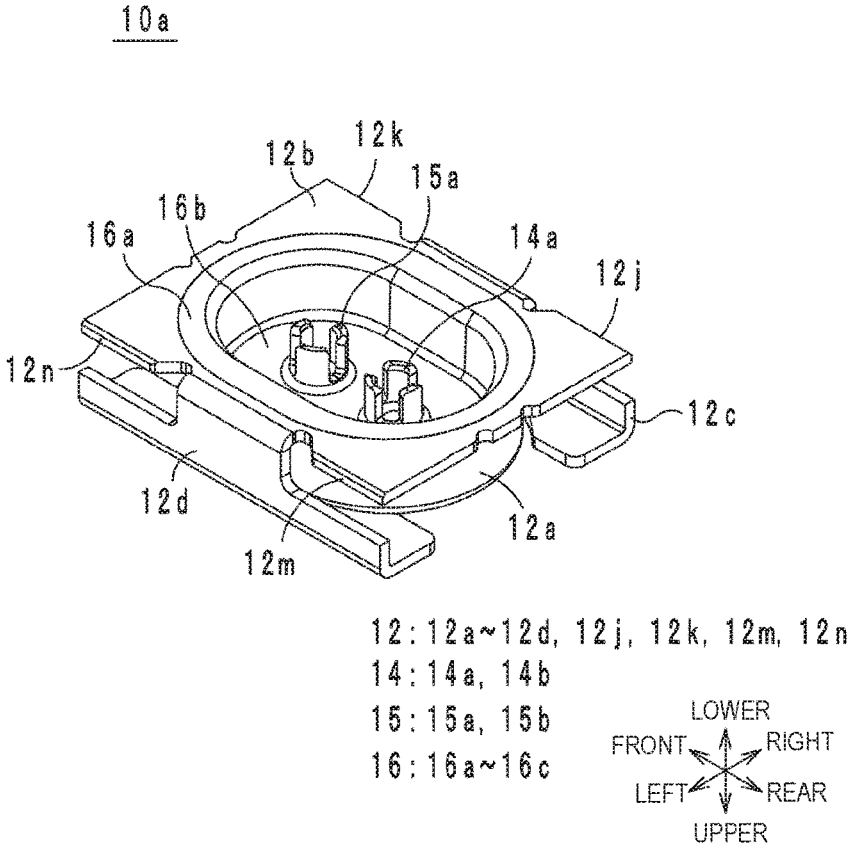
FIG. 13 is an external-appearance perspective view of a female connector when viewed from the upper side.

Hereinafter, a male connector 110*a*, a female connector 10*a*, and a connector set according to a first variation will be described with reference to the drawings. FIG. 12 is an external-appearance perspective view of the male connector 110*a* when viewed from the upper side. FIG. 13 is an external-appearance perspective view of the female connector 10*a* when viewed from the upper side.

The male connector 110 has the four support members 112*c*, 112*d*, 112*f* and 112*g*, and the two lock members 112*e* and 112*h*. Meanwhile, the male connector 110*a* has two support members 112*i* and 112*l*, and four lock members 112*j*, 112*k*, 112*m*, and 112*n*. Hereinafter, the male connector 110*a* will be described while focusing mainly on such differences.

The support member 112*i* is provided in the vicinity of the center of a right long side of the planar portion 112*b*. Since the structure of the support member 112*i* is similar to that of the support members 112*c* and 112*d*, description thereof will be omitted herein.

The lock member 112*j* is connected to the support member 112*i* from the rear side. In other words, the lock member 112*j* is positioned on the upper side of a right rear corner of the planar portion 112*b*. The lock member 112*k* is connected, from the front side, to the support member 112*i*. In other words, the lock member 112*k* is positioned on the upper side of a right front corner of the planar portion 112*b*. Since the lock members 112*j* and 112*k* have the same structure as that of the lock member 112*e*, description thereof will be omitted herein.

The support member 112*l* is provided in the vicinity of the center of a left long side of the planar portion 112*b*. Since the structure of the support member 112*l* is similar to that of the support members 112*f* and 112*g*, description thereof will be omitted herein.

The lock member 112*m* is connected to the support member 112*l* from the rear side. In other words, the lock member 112*m* is positioned on the upper side of a left rear corner of the planar portion 112*b*. The lock member 112*n* is connected, from the front side, to the support member 112*l*. In other words, the lock member 112*n* is positioned on the upper side of a left front corner of the planar portion 112*b*. Since the lock members 112*m* and 112*n* have the same structure as that of the lock member 112*h*, description thereof will be omitted herein. Further, since other structures of the male connector 110*a* are the same as those of the male connector 110, description thereof will be omitted.

The female connector 10 has two lock members 12*e* and 12*f*. Meanwhile, the female connector 10*a* has four lock members 12*j*, 12*k*, 12*m*, and 12*n*. Hereinafter, the female connector 10*a* will be described while focusing mainly on such differences.

The lock member 12*j* projects to the right side from the vicinity of the rear end of a right long side of a planar portion 12*b*. The lock member 12*k* projects to the right side from the vicinity of the front end of the right long side of the planar portion 12*b*. The lock member 12*m* projects to the left side from the vicinity of the rear end of a left long side of the planar portion 12*b*. The lock member 12*n* projects to the left side from the vicinity of the front end of the left long side of the planar portion 12*b*.

A support member 12*c* is connected to the vicinity of the center of the right long side of the planar portion 12*b*. A support member 12*d* is connected to the vicinity of the center of the left long side of the planar portion 12*b*. Since other structures of the female connector 10*a* are the same as those of the female connector 10, description thereof will be omitted.

In the connector set including the male connector 110*a* and the female connector 10*a*, the lock members 112*j*, 112*k*, 112*m*, and 112*n* push the lock members 12*j*, 12*k*, 12*m*, and 12*n*, respectively, to the lower side. As a result, when viewed from the upper side, the female connector 10*a* is fixed by the male connector 110*a* at four corners of the planar portion 12*b*.

According to the male connector 110*a*, the female connector 10*a*, and the connector set configured as described above, it is possible, both to suppress the intrusion or radiation of noise and to secure the fixing between the male connector 110 and the female connector 10 due to the same reason as that in the male connector 110, the female connector 10, and the connector set 1. According to the male connector 110*a*, the female connector 10*a*, and the connector set, it is possible to more effectively suppress the intrusion and the radiation of noise due to the same reason as that in the male connector 110, the female connector 10, and the connector set 1.

Further, according to the male connector 110*a*, the female connector 10*a*, and the connector set, it is possible to easily connect the male connector 110*a* and the female connector 10*a* to each other due to the same reason as that in the male connector 110, the female connector 10, and the connector set 1. Moreover, according to the male connector 110*a*, the female connector 10*a*, and the connector set, due to the same reason as that in the male connector 110, the female connector 10, and the connector set 1, it is possible to suppress a situation in which the insulators 116 and 16 are disengaged from the ground conductors 112 and 12 toward the upper side and the lower side, respectively.

Further, according to the male connector 110*a*, the female connector 10*a*, and the connector set, it is possible to visually recognize that the center conductors 114, 115, 14, and 15 are soldered to the land electrodes 204, 206, 224, and 226, respectively, due to the same reason as that in the male connector 110, the female connector 10, and the connector set 1. Furthermore, by providing the through-holes H1, H2, and H3, flux rising is suppressed.

According to the male connector 110*a*, the female connector 10*a*, and the connector set, it is possible to accurately perform the positioning of the male connector 110*a* and the female connector 10*a* in the front-rear direction and in the left-right direction, due to the same reason as that in the male connector 110, the female connector 10, and the connector set 1. In addition, according to the male connector 110*a*, the female connector 10*a*, and the connector set, it is possible to suppress the intrusion or radiation of noise, due to the same reason as that in the male connector 110, the female connector 10, and the connector set 1.

Further, according to the male connector 110*a*, the female connector 10*a*, and the connector set, it is possible to effectively suppress the rotation of the female connector 10*a* about the center axis Ax2 of the outer conductor 12*a* as compared with the male connector 110, the female connector 10, and the connector set 1. More specifically, when viewed from the upper side, the lock members 112*e* and 112*h* fix the vicinity of the center of each of the right and left long sides of the female connector 10. Meanwhile, when viewed from the upper side, the lock members 112*j*, 112*k*, 112*m*, and 112*n* fix the four corners of the female connector 10*a*. A distance from the center axis of the outer conductor 12*a* to each of the lock members 112*j*, 112*k*, 112*m*, and 112*n* is larger than a distance from the center axis of the outer conductor 12*a* to each of the lock members 112*e* and 112*h*. Therefore, the moment that each of the lock members 112*j*, 112*k*, 112*m*, and 112*n* applies to the planar portion 12*b* is larger than the moment that each of the lock members 112*e* and 112*h* applies to the planar portion 12*b*. These moments prevent the female connectors 10 and 10*a* from rotating about the center axis. As a result, according to the male connector 110*a*, the female connector 10*a*, and the connector set, it is possible to effectively suppress the rotation of the female connector 10*a* about the center axis of the outer conductor 12*a* as compared with the male connector 110, the female connector 10, and the connector set 1.

(Second Variation)

Figure 14:
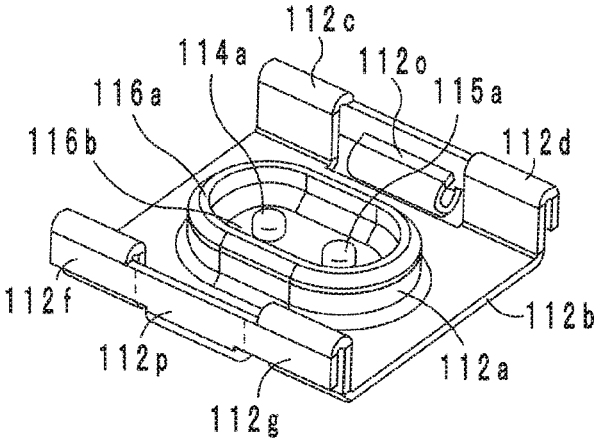
FIG. 14 is an external-appearance perspective view of a male connector when viewed from the upper side.
Figure 14:
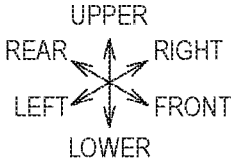

Hereinafter, a male connector 110*b* according to a second variation will be described with reference to the accompanying drawings. FIG. 14 is an external-appearance perspective view of the male connector 110*b* when viewed from the upper side. In this case, a female connector to which the male connector 110*b* is connected is the female connector 10. Hereinafter, the male connector 110*b* will be described, while the description of the female connector 10 will be omitted.

In the male connector 110, the lock member 112*e* extends toward the upper side from the portion connected to the support members 112*c* and 112*d*, and bends leftward (that is, in the direction approaching the outer conductor 112*a*) so as to extend toward the lower side. Further, the lock member 112*h* extends toward the upper side from the portion connected to the support members 112*f* and 112*g*, and bends rightward (that is, in the direction approaching the outer conductor 112*a*) so as to extend toward the lower side.

Meanwhile, in the male connector 110*b*, a lock member 112*o* extends toward the lower side from a portion connected to support members 112*c* and 112*d*, and bends leftward (that is, in a direction approaching an outer conductor 112*a*) so as to extend toward the upper side. Further, a lock member 112*p* extends toward the lower side from a portion connected to support members 112*f* and 112*g*, and bends rightward (that is, in the direction approaching the outer conductor 112*a*) so as to extend toward the upper side. Since other structures of the male connector 110*b* are the same as those of the male connector 110, description thereof will be omitted herein.

According to the male connector 110*b*, the female connector 10, and the connector set configured as described above, due to the same reason as that in the male connector 110, the female connector 10, and the connector set 1, both suppressing the intrusion or radiation of noise and securing the fixing between the male connector 110 and the female connector 10 are achieved. Further, according to the male connector 110*b*, the female connector 10, and the connector set, it is possible to more effectively suppress the intrusion and radiation of noise due to the same reason as that in the male connector 110, the female connector 10, and the connector set 1.

Furthermore, according to the male connector 110*b*, the female connector 10, and the connector set, it is possible to easily connect the male connector 110 and the female connector 10 to each other, due to the same reason as that in the male connector 110, the female connector 10, and the connector set 1. Moreover, according to the male connector 110*b*, the female connector 10, and the connector set, due to the same reason as that in the male connector 110, the female connector 10, and the connector set 1, the male connector 110 and the female connector 10 are firmly fixed.

In addition, according to the male connector 110*b*, the female connector 10, and the connector set, due to the same reason as that in the male connector 110, the female connector 10, and the connector set 1, it is suppressed that the insulators 116 and 16 are disengaged from the ground conductors 112 and 12 toward the upper side and the lower side, respectively. Further, according to the male connector 110*b*, the female connector 10, and the connector set, it is possible to visually recognize that the center conductors 114, 115, 14, and 15 are soldered to the land electrodes 204, 206, 224, and 226, respectively, due to the same reason as that in the male connector 110, the female connector 10, and the connector set 1. Furthermore, by providing the through-holes H1, H2, and H3, flux rising is suppressed.

According to the male connector 110*b*, the female connector 10, and the connector set, it is possible to accurately perform the positioning of the male connector 110*b* and the female connector 10 in the front-rear direction and in the left-right direction, due to the same reason as that in the male connector 110, the female connector 10, and the connector set 1. Further, according to the male connector 110*b*, the female connector 10, and the connector set, it is possible to suppress the intrusion or radiation of noise due to the same reason as that in the male connector 110, the female connector 10, and the connector set 1.

Further, according to the male connector 110*b*, as compared with the male connector 110, the lock members 112*o* and 112*p* can be elastically deformed largely. More specifically, in the male connector 110, when the ground conductor 112 is spread out on a plane, the lock member 112*e* has a band shape extending toward the left side. Therefore, the length of the lock member 112*e* is limited to a condition that the left end of the lock member 112*e* does not come into contact with the planar portion 112*b* in a state in which the ground conductor 112 is spread out on the plane. In contrast, in the male connector 110*b*, when the ground conductor 112 is spread out on a plane, the lock member 112*o* has a band shape extending toward the right side. Therefore, the length of the lock member 112*o* is not limited to the above-mentioned condition. Thus, it is possible to make the length of a lock member 12*o* longer than the length of the lock member 12*e*. Due to the same reason described above, it is possible to make the length of a lock member 12*p* longer than the length of a lock member 12*h*. Thus, according to the male connector 110*b*, it is possible to elastically deform the lock members 112*o* and 112*p* largely, in comparison with the male connector 110. In other words, even if the lock members 12*o* and 12*p* are largely deformed, plastic deformation is unlikely to occur, and breakage of the lock members 12*o* and 12*p* is suppressed.

(Third Variation)

Figure 15:
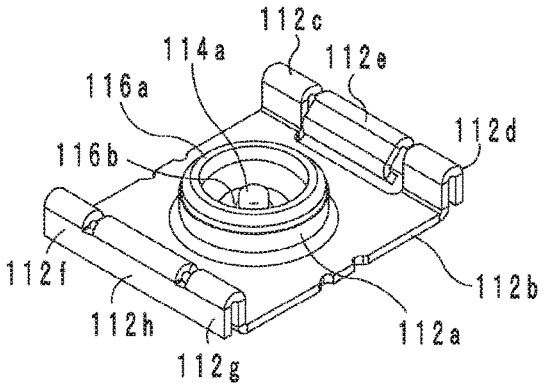
FIG. 15 is an external-appearance perspective view of a male connector when viewed from the upper side.
Figure 15:
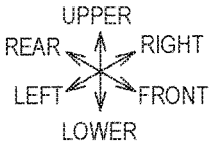
Figure 16:
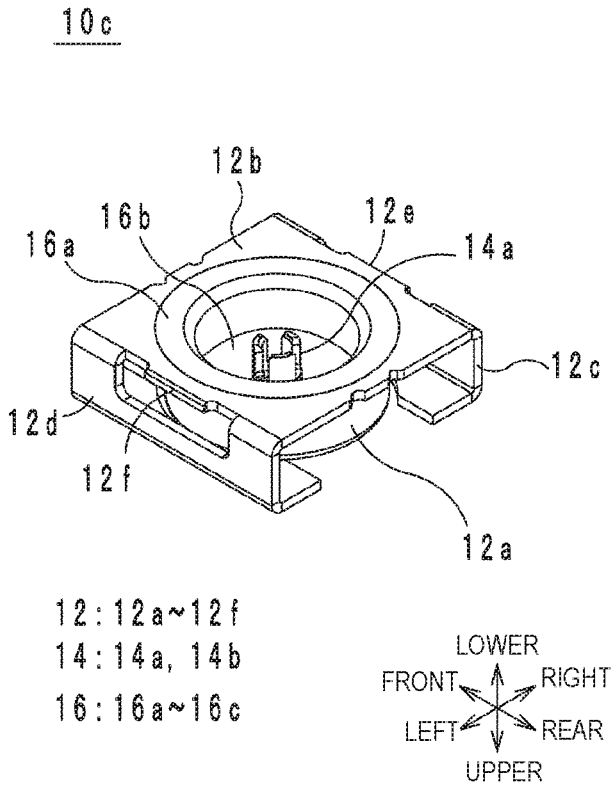
FIG. 16 is an external-appearance perspective view of a female connector when viewed from the lower side.
Figure 17:
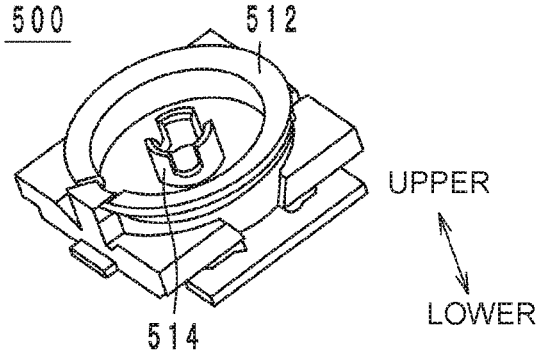
FIG. 17 is an external-appearance perspective view of the coaxial connector plug described in International Publication No. 2013/046829.
Figure 18:
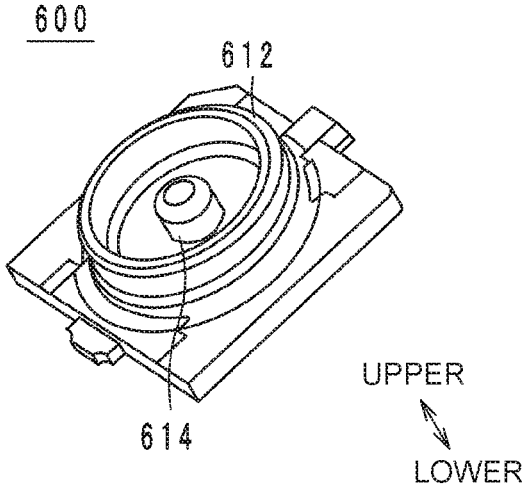
FIG. 18 is an external-appearance perspective view of the coaxial connector receptacle described in International Publication No. 2013/046829.

Hereinafter, a male connector 110*c*, a female connector 10*c*, and a connector set according to a third variation will be described with reference to the drawings. FIG. 15 is an external-appearance perspective view of the male connector 110*c* when viewed from the upper side. FIG. 16 is an external-appearance perspective view of the female connector 10*c* when viewed from the lower side.

The male connector 110*c* differs from the male connector 110 in the number of center conductors and in the shape of an outer conductor. More specifically, in the male connector 110*c*, an outer conductor 112*a* forms a circular ring when viewed from the upper side. In addition, the male connector 110C includes one center conductor 114. The center conductor 114 is disposed at the center of the outer conductor 112*a* when viewed from the upper side. Since other structures of the male connector 110*c* are the same as those of the male connector 110, description thereof will be omitted herein.

The female connector 10*c* differs from the female connector 10 in the number of center conductors and in the shape of an outer conductor. More specifically, in the female connector 10*c*, an outer conductor 12*a* forms a circular ring when viewed from the lower side. Further, the female connector 10*c* includes one center conductor 14. The center conductor 14 is disposed at the center of the outer conductor 12*a* when viewed from the lower side. Since other structures of the female connector 10*c* are the same as those of the female connector 10, description thereof will be omitted herein.

According to the male connector 110*c*, the female connector 10*c*, and the connector set configured as described above, it is possible to obtain the same effects as those of the male connector 110, the female connector 10, and the connector set.

Other Embodiments

The male connectors, the female connectors, and the connector sets according to the present disclosure are not limited to the male connectors 110 and 110*a* to 110*c*, the female connectors 10 and 10*a*, and 10*c*, and the connector set 1, and can be changed within the spirit and scope of the disclosure.

The respective configurations of the male connectors 110 and 110*a* to 110*c*, the female connectors 10 and 10*a*, and 10*c*, and the connector set 1 may be arbitrarily combined.

The upper ends of the center conductors 114 and 115 may protrude or may not protrude from the upper end of the outer conductor 112*a*. In the male connectors 110 and 110*a* to 110*c*, the height of the upper end of the center conductors 114 and 115 in the upper-lower direction and the height of the upper end of the outer conductor 112*a* in the upper-lower direction are at the same level of position. However, from the viewpoint of reducing the intrusion and radiation of noise, it is desirable that the upper end of each of the center conductors 114 and 115 does not protrude from the upper end of the outer conductor 112*a*.

The lower ends of the center conductors 14 and 15 may protrude or may not protrude from the lower end of the outer conductor 12*a*. However, from the viewpoint of reducing the intrusion and radiation of noise, it is desirable that the lower end of each of the center conductors 14 and 15 does not protrude from the lower end of the outer conductor 12*a*, like in the female connectors 10, 10*a*, and 10*c*.

Further, it is assumed that the upper surface Sa of the planar portion 112*b* and the lower surface Sc of the planar portion 12*b* are in surface contact with each other. However, the planar portion 112*b* and the planar portion 12*b* may be in line contact with each other.

Further, although the outer conductor 112*a* is inserted in the outer conductor 12*a*, the outer conductor 12*a* may be inserted in the outer conductor 112*a*.

Note that the through-holes H1 to H3 may not be provided.

In addition, a projection or a recess may be provided on the inner circumference surface of the outer conductor 112*a*. With this, the insulator 116 comes into contact with the surface facing the upper side and the surface facing the lower side in the outer conductor 112*a*. A projection or a recess may be provided on the inner circumference surface of the outer conductor 12*a*. With this, the insulator 16 comes into contact with the surface facing the upper side and the surface facing the lower side in the outer conductor 12*a*.

Thus far, the description has been given considering that the first connector refers to the male connectors 110 and 110*a* to 110*c*, and the second connector refers to the female connectors 10, 10*a*, and 10*c*. However, the second connector may refer to the male connectors 110 and 110*a* to 110*c*, and the first connector may refer to the female connectors 10, 10*a*, and 10*c*.

As described above, the present disclosure is useful for a connector, a connector set, and a method for manufacturing the connector, and is particularly excellent in that noise intrusion or radiation can be suppressed.

What is claimed is:

1. A first connector configured to connect, from one side of a first direction, to a second connector provided with a second ground conductor including a second outer conductor formed in a cylindrical shape and having a virtual second center axis extending in the first direction, the first connector comprising:

a first ground conductor including a first outer conductor formed in a cylindrical shape and having a virtual first center axis extending in the first direction, and a first contact section connected to the first outer conductor;

a first center conductor provided in an area surrounded by the first outer conductor when viewed from the first direction;

a first insulator provided in the area surrounded by the first outer conductor when viewed from the first direction and configured to fix relative positions of the first center conductor and the first outer conductor; and a first lock member, wherein, in a case where the first connector and the second connector are connected to each other, the first outer conductor is inserted in the second outer conductor or the second outer conductor is inserted in the first outer conductor, and in the case where the first connector and the second conductor are connected to each other, the first lock member pushes the second connector toward the one side of the first direction, and the first contact section makes contact with the second ground conductor in such a manner as to surround a periphery of the first outer conductor when viewed from the first direction.

2. The first connector according to claim 1, wherein the first lock member is elastically deformed to push the second connector toward the one side of the first direction when the first connector and the second connector are connected.

3. The first connector according to claim 1, wherein the first ground conductor includes the first lock member, and the first lock member is a leaf spring in which part of the first ground conductor is bent.

4. The first connector according to claim 3, wherein the first ground conductor further includes a first support member connected to the first contact section, and the first lock member is connected to the first support member.

5. The first connector according to claim 4, wherein the first lock member extends from a portion connected to the first support member toward the other side of the first direction, and bends toward a direction approaching the first outer conductor so as to extend toward the one side of the first direction.

6. The first connector according to claim 4, wherein the first lock member extends from a portion connected to the first support member toward the one side of the first direction, and bends toward a direction approaching the first outer conductor so as to extend toward the other side of the first direction.

7. The first connector according to claim 4, wherein the first ground conductor further includes a second support member connected to the first contact section, the first support member and the second support member are aligned at a given interval in a second direction orthogonal to the first direction, and the first lock member is located between the first support member and the second support member, and is connected to the first support member and the second support member.

8. The first connector according to claim 1, wherein the first insulator is in contact with a surface of the first outer conductor facing the one side of the first direction.

9. The first connector according to claim 1, wherein the first insulator is in contact with a surface of the first outer conductor facing the other side of the first direction.

10. The first connector according to claim 1, wherein the first insulator is provided with a through-hole passing through the first insulator in the first direction, and the through-hole is located in the area surrounded by the first outer conductor when viewed from the first direction.

11. The first connector according to claim 2, wherein the first ground conductor includes the first lock member, and the first lock member is a leaf spring in which part of the first ground conductor is bent.

12. The first connector according to claim 2, wherein the first insulator is in contact with a surface of the first outer conductor facing the one side of the first direction.

13. The first connector according to claim 2, wherein the first insulator is in contact with a surface of the first outer conductor facing the other side of the first direction.

14. The first connector according to claim 2, wherein the first insulator is provided with a through-hole passing through the first insulator in the first direction, and the through-hole is located in the area surrounded by the first outer conductor when viewed from the first direction.

15. A connector set comprising a first connector and a second connector, wherein the first connector and the second connector are connected to each other in such a manner that the first connector is positioned on one side of a first direction relative to the second connector, the first connector includes, a first ground conductor including a first outer conductor formed in a cylindrical shape and having a virtual first center axis extending in the first direction, and a first contact section connected to the first outer conductor, a first center conductor provided in an area surrounded by the first outer conductor when viewed from the first direction, a first insulator provided in the area surrounded by the first outer conductor when viewed from the first direction and configured to fix relative positions of the first center conductor and the first outer conductor, and a first lock member, the second connector includes, a second ground conductor including a second outer conductor formed in a cylindrical shape and having a virtual second center axis extending in the first direction, and a second contact section connected to the second outer conductor, a second center conductor provided in an area surrounded by the second outer conductor when viewed from the first direction, a second insulator provided in the area surrounded by the second outer conductor when viewed from the first direction and configured to fix relative positions of the second center conductor and the second outer conductor, and a second lock member, the first outer conductor is inserted in the second outer conductor or the second outer conductor is inserted in the first outer conductor, the first center conductor and the second center conductor are connected to each other, in a case where the first connector and the second conductor are connected to each other, the first lock member pushes the second lock member toward the one side of the first direction, and in the case where the first connector and the second connector are connected to each other, the first contact section and the second contact section make contact with each other in such a manner as to surround a periphery of the first outer conductor and the second outer conductor when viewed from the first direction.

16. The connector set according to claim 15, wherein the first contact section has a first plane orthogonal to the first direction, and the second contact section has a second plane orthogonal to the first direction, and when the first connector and the second connector are connected to each other, the first plane and the second plane are brought into contact with each other.

17. The connector set according to claim 15, wherein the first outer conductor is inserted in the second outer conductor, and the second insulator covers an inner circumference surface of the second outer conductor.

18. The connector set according to claim 16, wherein the first outer conductor is inserted in the second outer conductor, and the second insulator covers an inner circumference surface of the second outer conductor.

19. A manufacturing method for the first connector according to claim 1, the method comprising:

integrating the first ground conductor and the first center conductor by insert molding using the first insulator made of a resin material.

20. A manufacturing method for the first connector according to claim 1, the method comprising:

insert molding of any one of the first ground conductor and the first center conductor using the first insulator made of a resin material; and press fitting of the other one of the first ground conductor and the first center conductor into the first insulator.

* * * * *